US006739778B2

(12) United States Patent
Fuchi et al.

(10) Patent No.: US 6,739,778 B2
(45) Date of Patent: May 25, 2004

(54) SHEET TRANSPORT DEVICE

(75) Inventors: Masami Fuchi, Daito (JP); Hideaki Kimata, Itami (JP); Mitsuhiro Shibata, Higashiosaka (JP); Tsuyoshi Koyanagi, Osaka (JP); Yuzo Onishi, Shijonawate (JP)

(73) Assignee: Kyocera Mita Corporation, Osaka (JP)

( * ) Notice: Subject to any disclaimer, the term of this patent is extended or adjusted under 35 U.S.C. 154(b) by 8 days.

(21) Appl. No.: 10/094,771

(22) Filed: Mar. 11, 2002

(65) Prior Publication Data

US 2002/0141800 A1 Oct. 3, 2002

(30) Foreign Application Priority Data

Mar. 27, 2001 (JP) ..... 2001-091163

(51) Int. Cl.[7] ..... B41J 29/02; B41J 29/00; G03G 15/00

(52) U.S. Cl. ..... 400/693; 399/110; 399/388; 399/391

(58) Field of Search ..... 399/110, 388, 399/391; 271/222; 400/691, 693; 347/108, 70

(56) References Cited

U.S. PATENT DOCUMENTS 5,052,670 A * 10/1991 Makiura et al. ..... 271/9.13
5,567,068 A * 10/1996 Egashira et al. ..... 400/625
6,068,420 A * 5/2000 Austin et al. ..... 400/693
6,332,611 B1 * 12/2001 Tomita ..... 271/273
6,526,255 B2 * 2/2003 Itoh et al. ..... 399/401
2001/0012462 A1 * 8/2001 Motohashi et al. ..... 399/401

FOREIGN PATENT DOCUMENTS

JP 11322130 A * 11/1999 ..... B65H/7/06
JP 2001019177 A * 1/2001 ..... B65H/1/26

* cited by examiner

*Primary Examiner*—Daniel J. Colilla
(74) *Attorney, Agent, or Firm*—Jordan and Hamburg LLP

(57) ABSTRACT

Disclosed is a sheet transport device for use in an image forming apparatus in which one surface of a guide member and one surface of a first counterpart member define a first sheet transport path, and the opposite surface of the guide member and one surface of a second counterpart member define a second sheet transport path. The second counterpart member is pivotally supported on a main body of the image forming apparatus to be selectively set to a closed position for defining the second sheet transport path and an opened position for exposing an interior of the second sheet transport path. The guide member is pivotally supported on the main body of the image forming apparatus to be selectively set to a closed position for defining the first sheet transport path and a closed position for exposing an interior of the first sheet transport path. The sheet transport device has retaining means for retaining the guide member at the closed position. The guide member is retained at the closed position when the second counterpart member is set to the opened position by the retaining means.

8 Claims, 17 Drawing Sheets

PRIOR ART

PRIOR ART

SHEET TRANSPORT DEVICE

BACKGROUND OF THE INVENTION

1. Field of the Invention

This invention relates to a sheet transport device for use in an image forming apparatus such as a copier, a facsimile machine, a printer, and a scanner to transport recording paper, documents, and the like.

2. Description of the Related Art

There are known sheet transport devices equipped with a plurality of sheet transport paths. Recently, copiers incorporated with a plurality of sheet cassettes have been widespread. Such a copier is generally equipped with a plurality of sheet transport paths.

FIG. 15 is a perspective view of a copier incorporated with a plurality of sheet cassettes arranged at respective positions, specifically showing a state that a side door of the copier is opened. FIGS. 16A and 16B are enlarged sectional views illustrating a conventional sheet transporting section of a copier. FIG. 16A shows a state that a side door of the copier is closed, and FIG. 16B shows a state that the side door is opened.

The aforementioned copier is equipped with a group of sheet cassettes 111 consisting of, for example, four sheet cassettes 111*a*, 111*b*, 111*c*, and 111*d* each accommodating a stack of sheets therein. The copier is constructed in such a manner that a copy sheet 115 is dispensed from an arbitrary sheet cassette of the sheet cassette group 111, fed to an image forming section via a specified sheet transport path, has an image formed and fixed thereon, and is discharged onto a discharge tray.

The sheet transporting section is adapted to transport a sheet 115 dispensed from any one of the sheet cassettes 111*a* to 111*d* to the image forming section located at an upper part of the copier along a specified transport path from upstream toward downstream with respect to a sheet transport direction.

Specifically, as shown in FIGS. 16A and 16B, each sheet cassette has the following configuration. For example, the uppermost sheet cassette 111*a* has a first sheet transport path 211 along which a sheet 115 dispensed therefrom is transported toward the image forming section, and a second sheet transport path 212 along which a sheet 115 dispensed from a lower-side sheet cassette (e.g., sheet cassette 111*b*) is transported toward the image forming section. The first sheet transport path 211 and the second sheet transport path 212 are jointed at an upper part of the sheet cassette and directed upward. Likewise, the sheet cassette located below the sheet cassette 111*a* (for example, sheet cassette 111*b*) has a sheet transport path (namely, a first sheet transport path 211) dedicatedly used for the sheet cassette 111*b*, and a sheet transport path (namely, a second sheet transport path 212) which extends from a lower-side sheet cassette and is jointed at an upper part of the sheet cassette 111*b* (see the upper part of each sheet cassette in FIGS. 16A and 16B).

A guide member 220 for switching over a sheet transport path between the first sheet transport path 211 and the second sheet transport path 212 is provided at each jointed part of the first sheet transport path 211 and the second sheet transport path 212. When a side door 230 is opened in the direction shown by the arrow A in FIG. 16B, the guide member 220 is changeable to an opened position by pivotal rotation thereof indicated by the arrow B in FIG. 16B, whereby the interior of the first sheet transport path 211 is exposed. When the guide member 220 is set to the opened position, an operator can remove a sheet jammed or staying in the first sheet transport path 211. Likewise, the second sheet transport path 212 is exposed outside when the side door 230 is opened, whereby an operator can remove a jammed sheet from the second sheet transport path 212.

Changing over the guide member 220 between the opened position (position for exposing the interior of the first sheet transport path 211) and the closed position (position for defining the first sheet transport path 211 of a certain configuration) is associated with opening and closing of the side door 230. Closing the side door 230 pivotally rotates the guide member 220 to the closed position by pressing a lead end of the guide member 220 against an inner wall of the side door 230 (see FIG. 16A). Opening the side door 230 releases pressing of the guide member 220 to thereby allow the guide member 220 to pivotally set to the opened position (see FIG. 16B).

The copier shown in FIGS. 15 to 16B is operated in such a manner that the side door 230 is pivotally openable about a vertical axis. Hereafter, this type of copier is also referred to as "sideways openable copier". In the case of a copier operated in such a manner that a side At door is pivotally openable about a horizontal axis (hereafter, also referred to as "vertically openable copier"), similar to the sideways openable copier, an operation of a guide member for switching over a sheet transport path between a first sheet transport path and a second sheet transport path is associated with opening and closing of the side door. Pressing a lead end of the guide member against the inner wall of the side door pivotally sets the guide member to the closed position. FIG. 17 is a sectional view of a vertically openable copier specifically showing a state that a side door 230 is opened.

It is preferable to provide a guide member 220 having a relatively large size in order to set an opening angle of the guide member 220 with respect to a vertical plane as large as possible to sufficiently expose the interior of the first sheet transport path 211 in light of an operator's operability of removing a jammed sheet from the first sheet transport path 211 (see FIGS. 16A and 16B). However, the aforementioned conventional copier (specifically, sheet transport device) involves the following drawback.

Specifically, as shown in FIG. 18, which is a perspective view for illustrating open/close operations of the guide member 220 in association with open/close operations of the side door 230, pressing the guide member 220 by the side door 230 as the side door 230 is being closed enables to set the guide member 220 to the closed position. With this arrangement, it is likely that part on the inner surface of the side door 230 abutted against the guide member 220 (part indicated by the arrow C in FIG. 18A) is subjected to an abrasion or frictional resistance. Particularly, in the case where the guide member 220 is set at a large opening angle, the abutted part (region around the arrow C in FIG. 18) of the side door 230 and the guide member 220 is subjected to a high abrasion or frictional resistance. As shown in FIG. 18B, closing motion of the side door 230 about an axis V cannot be smoothly transferred to a rotational motion of the guide member 220 around an axis H because the closing motion of the side door 230 does not create a force, i.e., a upwardly acting force component to produce a moment MH, required to rotate the guide member 220 upward. Therefore, it is highly likely that the abutted part on the side door 230 and the guide member 220 are damaged or lost.

In the case of a vertically openable copier, although a physical load exerted to part of a side door and a guide member corresponding to the aforementioned abutted part is small compared to the case of a sideways openable copier, the part of the side door 230 and the guide member 220 is subjected to a physical load if the guide member 220 is attempted to be set at a large opening angle.

In view of the aforementioned drawbacks, in the conventional sheet transport device, a maximal openable angle of the guide member 220 is restricted, thus hindering operability in removing a jammed sheet.

SUMMARY OF THE INVENTION

In view of the above, it is an object of the invention to provide a sheet transport device free from the problems residing in the prior art.

It is a further object of the invention to provide a sheet transport device capable of setting an opening angle of a guide member as large as possible.

According to an aspect of this invention, a sheet transport device for use in an image forming apparatus, comprises: a guide member, which is pivotally supported on a main body of the image forming apparatus to be movable between a closed position and an opened position; a first counterpart member having a surface, which with one surface of the guide member, when in the closed position, forms a first sheet transport path; a second counterpart member which is pivotally supported on the main body of the image forming apparatus to be movable between a closed position and an opened position, said second counterpart member in the closed position forms a second sheet transport path with the opposite surface of the guide member in the closed position and said second counterpart member in the opened position exposes the interior of the second sheet transport path; and retaining means for retaining the guide member at the closed position when the second counterpart member is in the open position.

With this arrangement, an operator can remove a jammed sheet by setting the second counterpart member to the opened position and exposing the interior of the second sheet transport path. Also, the operator can remove a jammed sheet by setting the guide member to the opened position and exposing the interior of the first sheet transport path. Since the guide member is operable independently of opening/closing of the second counterpart member, and the retaining means retains the guide member at the closed position, the sheet transport device is free from a problem of loss and damage of part of the guide member and the second counterpart member (e.g., a side door) due to abrasion or frictional resistance as having been encountered in the conventional arrangement. Further, since guide member is operated independently of opening/closing of the second counterpart member, there is no limit to an opening angle of the guide member. For instance, the opening angle of the guide member may be set at 90° or larger. Setting the opening angle as wide as 90° or larger improves operability in removing a jammed sheet.

These and other objects, features and advantages of the present invention will become more apparent upon a reading of the following detailed description and accompanying drawing.

DETAILED DESCRIPTION OF THE PREFERRED EMBODIMENTS OF THE INVENTION

An entire arrangement of a copier incorporated with a sheet transport device embodying this invention is described with reference to FIG. 1.

Figure 1:
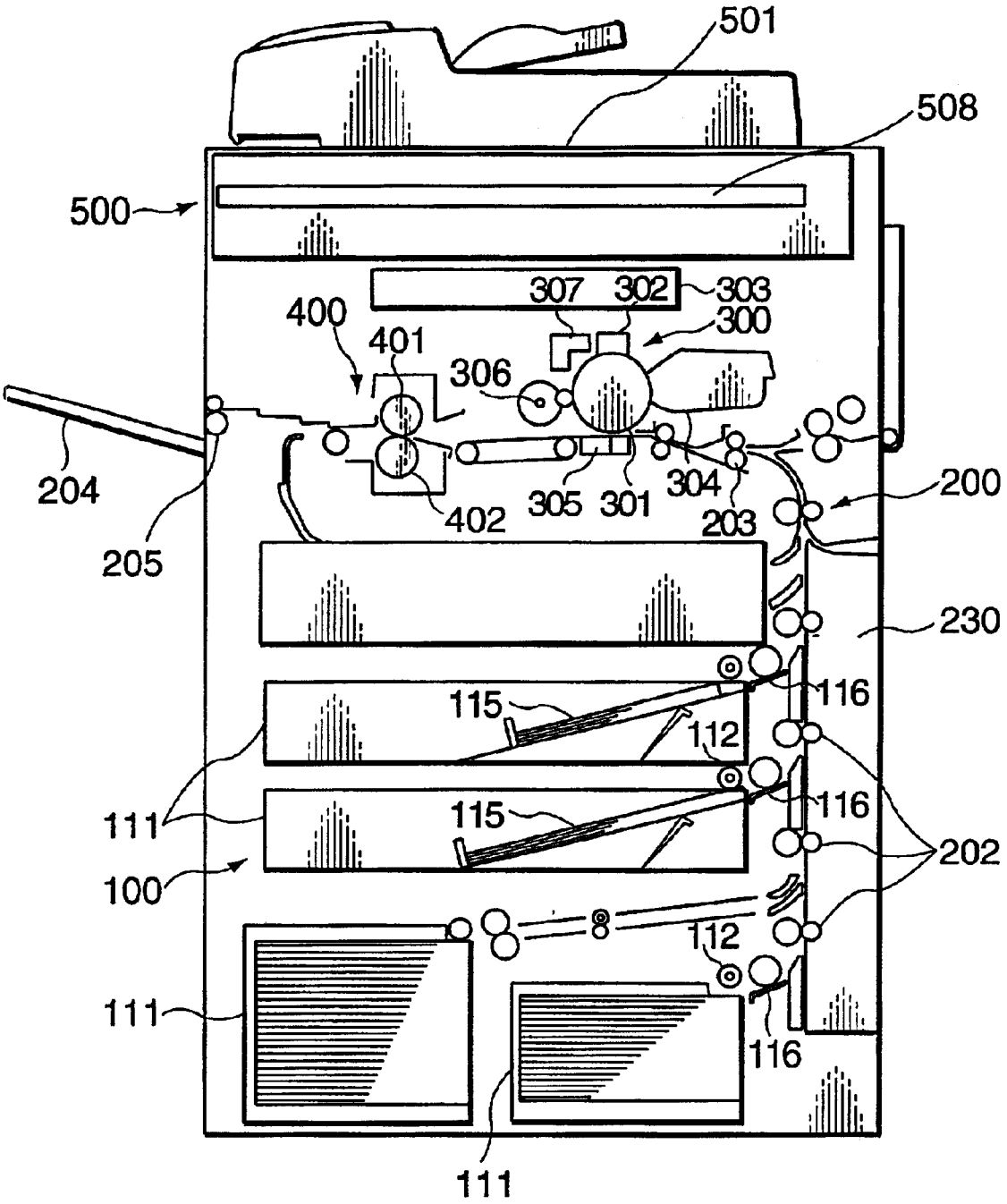
FIG. 1 is a sectional side view of a copier incorporated with a sheet transport device in accordance with an embodiment of this invention.
Figure 15:
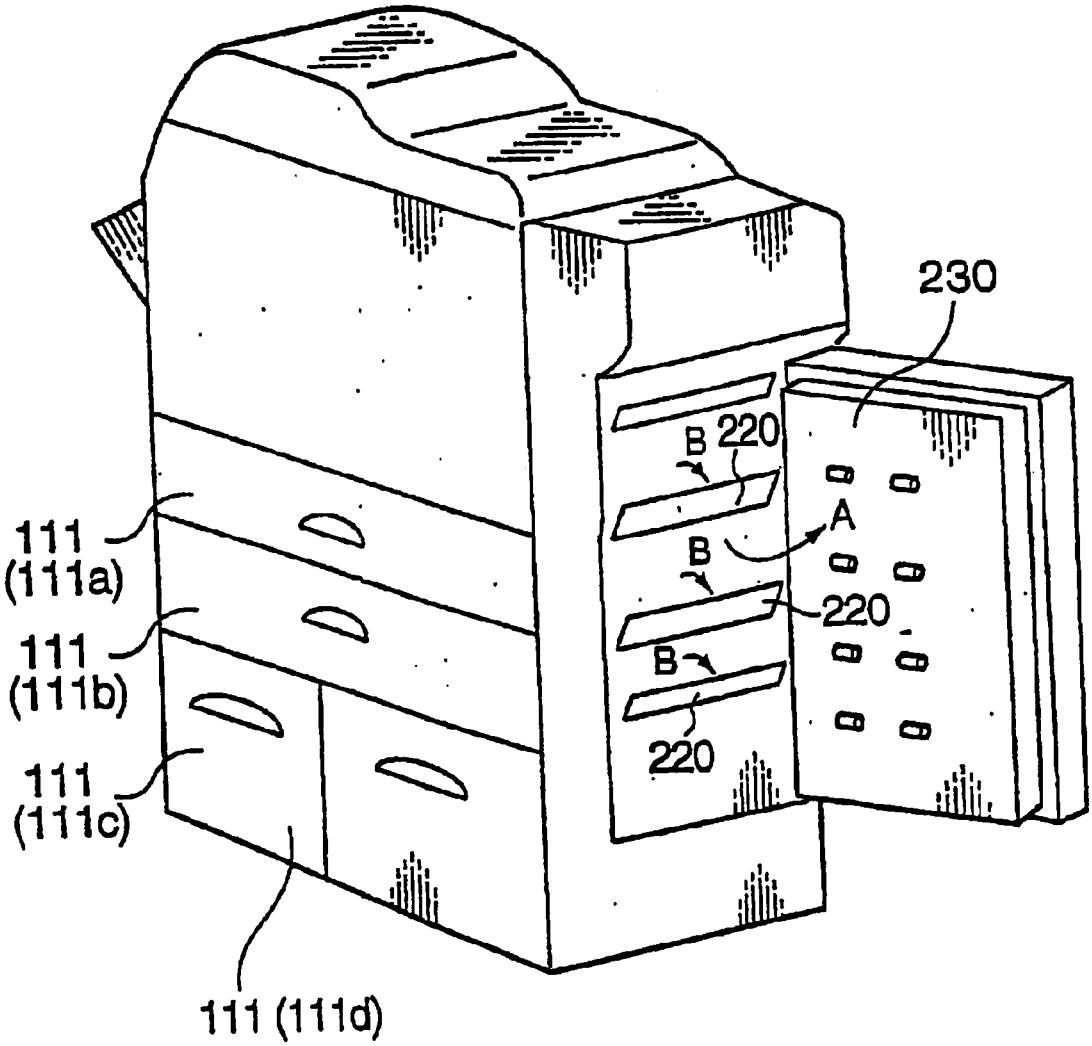
FIG. 15 is a perspective view of a copier equipped with a plurality of sheet cassettes.
Figure 16A:
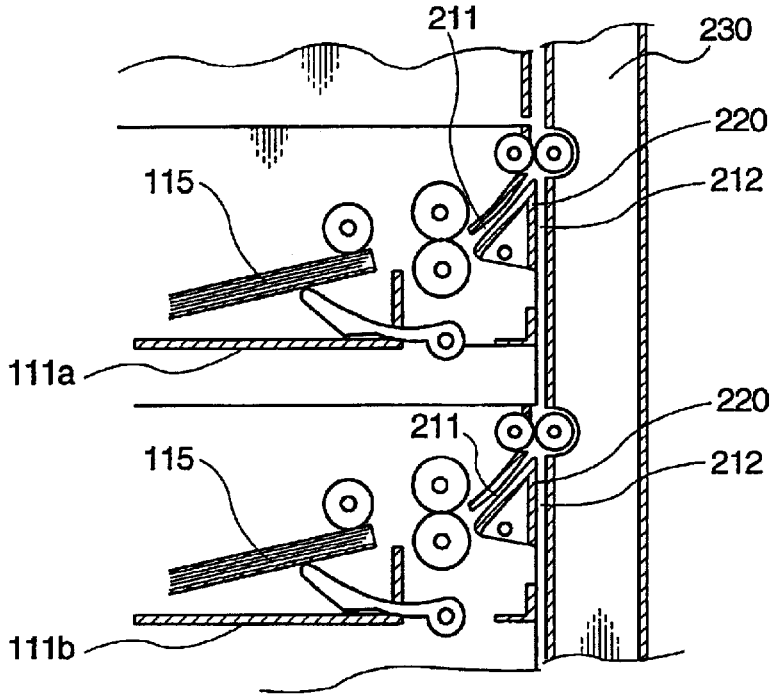
PRIOR ART FIG.16A
FIGS. 16A and 16B are enlarged sectional views each illustrating a conventional sheet transport device of a copier.
Figure 16B:
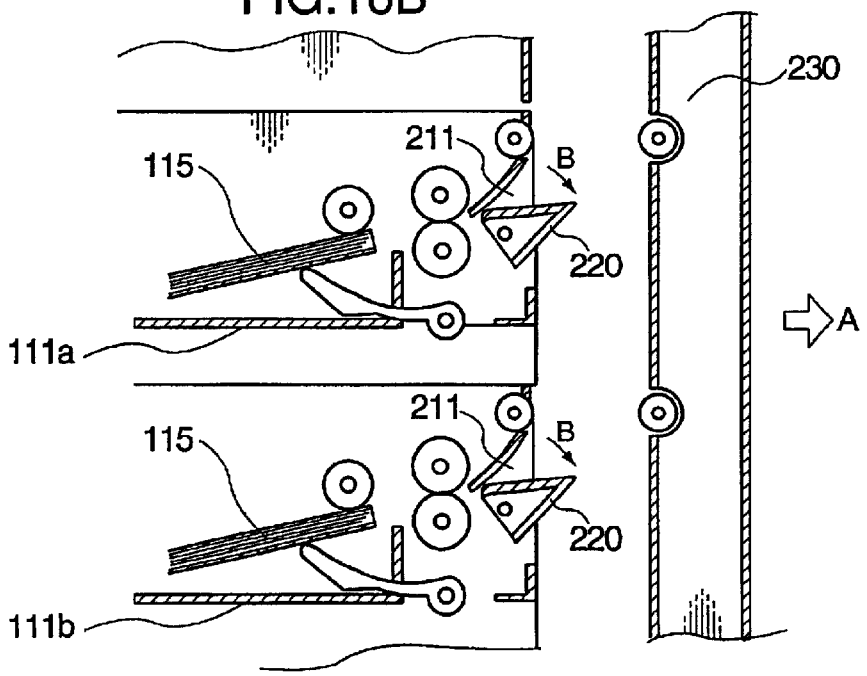
PRIOR ART FIG.16B
Figure 17:
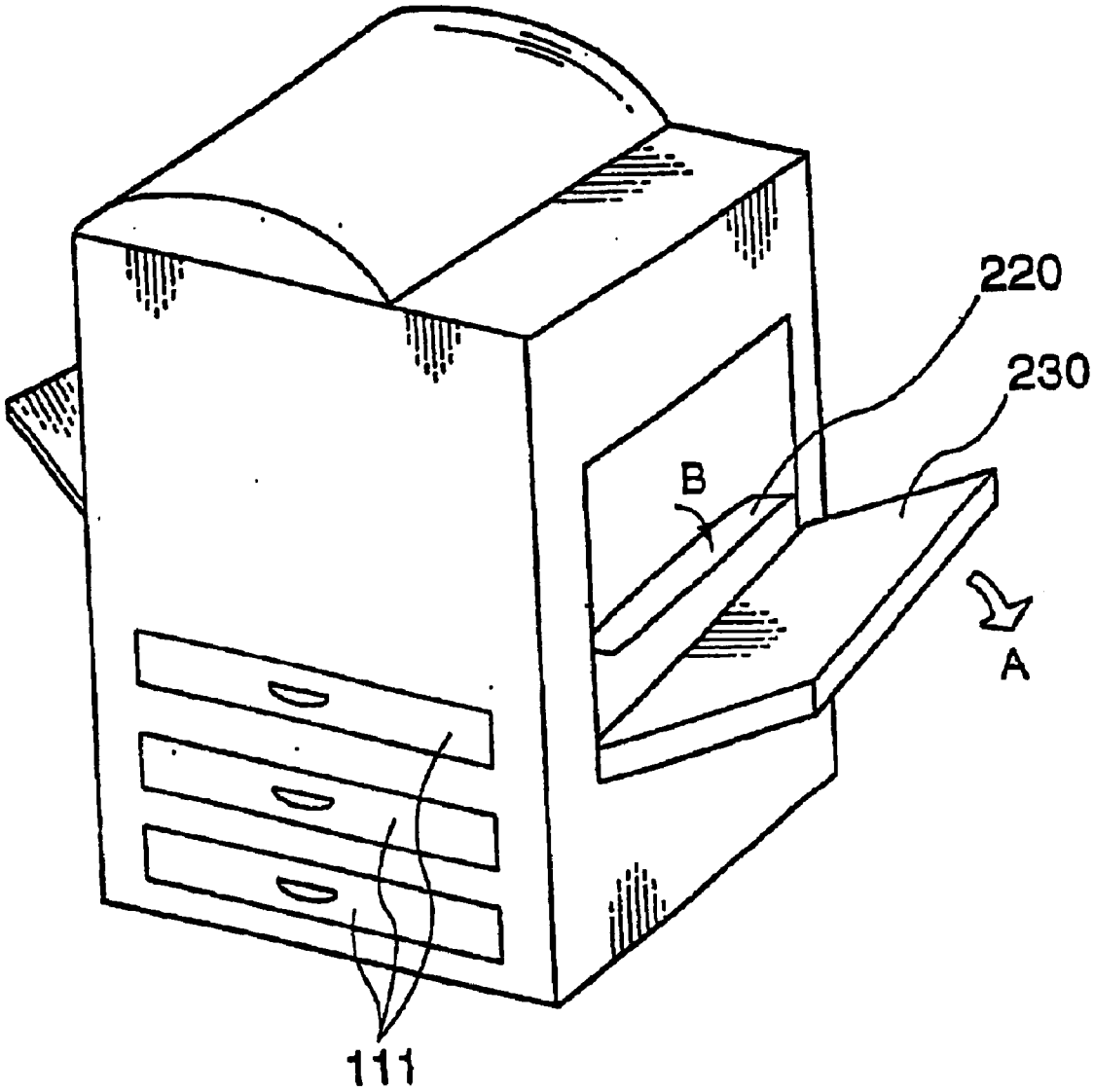
FIG. 17 is a diagram showing a vertically openable copier.
Figure 18A:
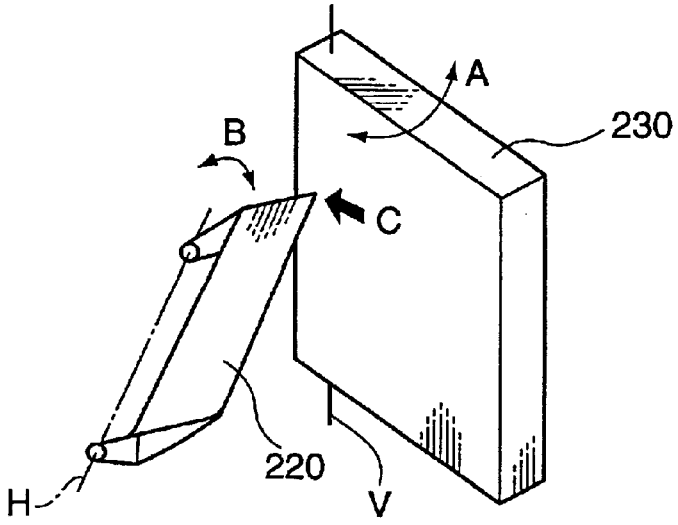
PRIOR ART FIG.18A
FIG. 18A is a perspective view for illustrating open/close operations of a guide member in association with open/close operations of a side door in a conventional sheet transport device.
Figure 18B:
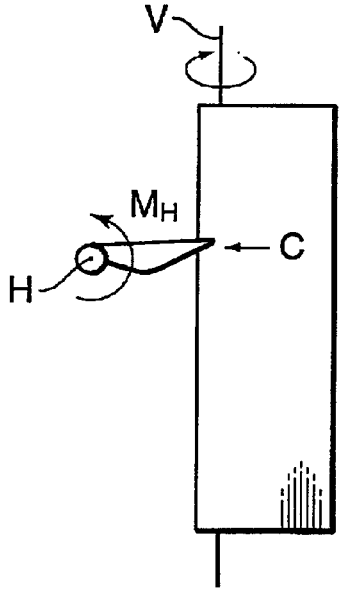
FIG. 18B is a horizontal view corresponding to FIG. 18A.

FIG. 1 is a cross sectional view exemplifying a copier incorporated with the sheet transport device in accordance with the embodiment. Elements of the embodiment identical to those of the conventional copier shown in FIGS. 15 to 16B are denoted at the same reference numerals, and a description thereof is omitted herein.

The copier includes a sheet storage section 100 located at a lower part of a main body of the copier, a sheet transporting section (sheet transport device) 200 which is located at a side part and an upper part of the sheet storage section 100, an image forming section 300 located above the sheet transporting section 100, an image fixing section 400 located at a downstream side in a sheet transport direction with respect to the image forming section 300, and an image reading section 500 including an optical device which is located above the image forming section 300 and the image fixing section 400.

The sheet storage section 100 is operated in such a manner that a copy sheet 115 is dispensed from one of four sheet cassettes 111 and is fed through an exit port formed in a right side of the sheet cassette 111 in FIG. 1 by rotation of a feed roller 112. As the sheet 115 is dispensed from the sheet cassette 111, the sheet 115 is separated by a pair of separation rollers 116 disposed on widthwise opposite ends of the sheet cassette 111 above the sheet cassette 111, thereby separating the uppermost sheet 115 from the remaining stack of sheets in the sheet cassette 111 to securely feed the uppermost sheet 115 to the sheet transporting section 200.

The sheet transporting section 200 is adapted to transport the sheet 115 dispensed from the sheet storage section 100 to the image forming section 300 by a transport roller pair 202 and a registration roller pair 203. When the sheet 115 is transported to the image forming section 300, the sheet 115 has an image formed thereon, and has its image fixed thereon by the image fixing section 400. After the image fixation, the sheet 115 is discharged onto a discharge tray 204 by way of a discharge roller pair 205.

The image forming section 300 is adapted to form a toner image on a sheet 115 by an electrophotographic image processing. The image forming section 300 includes a photosensitive drum 301 rotatable about an axis thereof and has a photoconductivity. A charging unit 302, an exposing unit 303, a developing unit 304, a transfer unit 305, a cleaner 306, and a blank lamp (charge removing unit) 307 are provided in this order along a periphery of the photosensitive drum 301 in a rotating direction thereof.

The charging unit 302 has a charging wire to which a high voltage is applied, and is adapted to apply a certain potential on the surface of the photosensitive drum 301 by corona discharge from the charging wire. The exposing unit 303 is adapted to form an electrostatic latent image on the surface of the photosensitive drum 301 by irradiating a laser beam emitted from a laser emitter onto the surface of the photosensitive drum 301 via a polygon mirror and a reflecting mirror based on image data which is obtained by reading a document image by the image reading section 500 in such a manner as to selectively attenuate the potential on the surface of the photosensitive drum 301. The developing unit 304 is adapted to develop a latent image into a toner image on the surface of the photosensitive drum 301. The transfer unit 305 is adapted to transfer the toner image formed on the surface of the photosensitive drum 301 onto a copy sheet 115. In the copier shown in FIG. 1, the transfer unit 305 includes a transfer roller disposed away from the photosensitive drum 301 by a certain distance. The cleaner 306 is adapted to remove toner residues on the surface of the photosensitive drum 301 after an image transfer. The blank lamp 307 is adapted to remove charge residues on the surface of the photosensitive drum 301.

The image fixing section 400 is arranged at a downstream side in the sheet transport direction with respect to the image forming section 300 and is adapted to fix a toner image on a sheet 115 by heating the sheet 115 having the toner image transferred thereon by the image forming section 300 while nipping the sheet 115 between a heater roller 401 and a presser roller 402 which is pressed against the heater roller 401.

The image reading section 500 is adapted to read image data from a document carrying an image by irradiating light from an exposure lamp onto the document placed on a contact glass 501 and by guiding light reflected from the document to a photoelectric converting section such as a CCD line sensor by way of a reflecting mirror. It should be appreciated that the exposure lamp and the reflecting mirror constitute an image scanning section. Reciprocating the image scanning section within an image scan area 508 in sideways directions of FIG. 1 at a certain speed enables to scan the entire surface of the document placed on the contact glass 501 so as to read an image on the entire surface of the document.

Next, the sheet transporting section (sheet transport device) 200 is described with reference to FIGS. 2 to 4.

Figure 2:
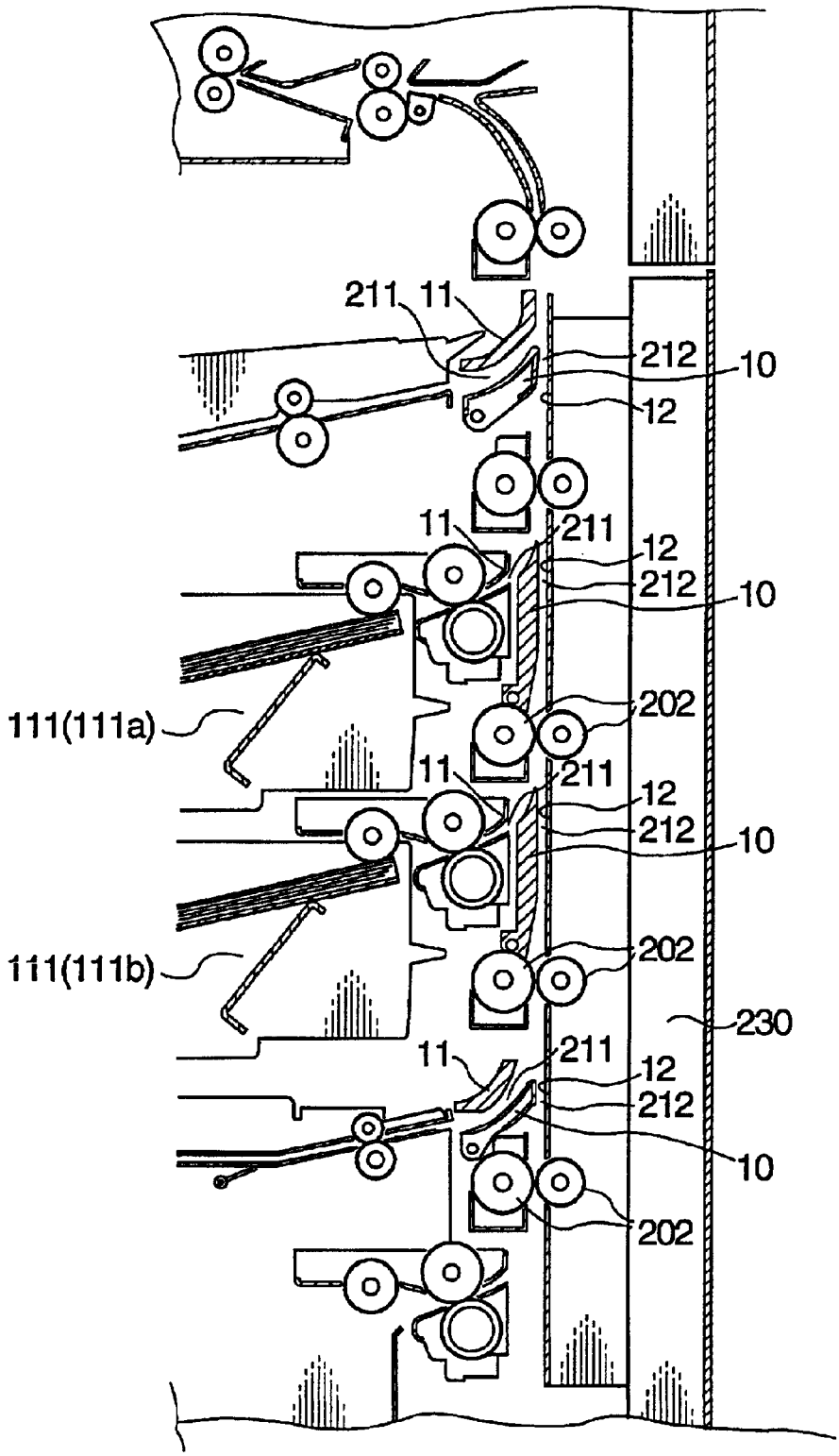
FIG. 2 is a sectional view of the sheet transport device and its vicinity shown in FIG. 1, specifically showing a state that a side door of the copier is closed.
Figure 3:
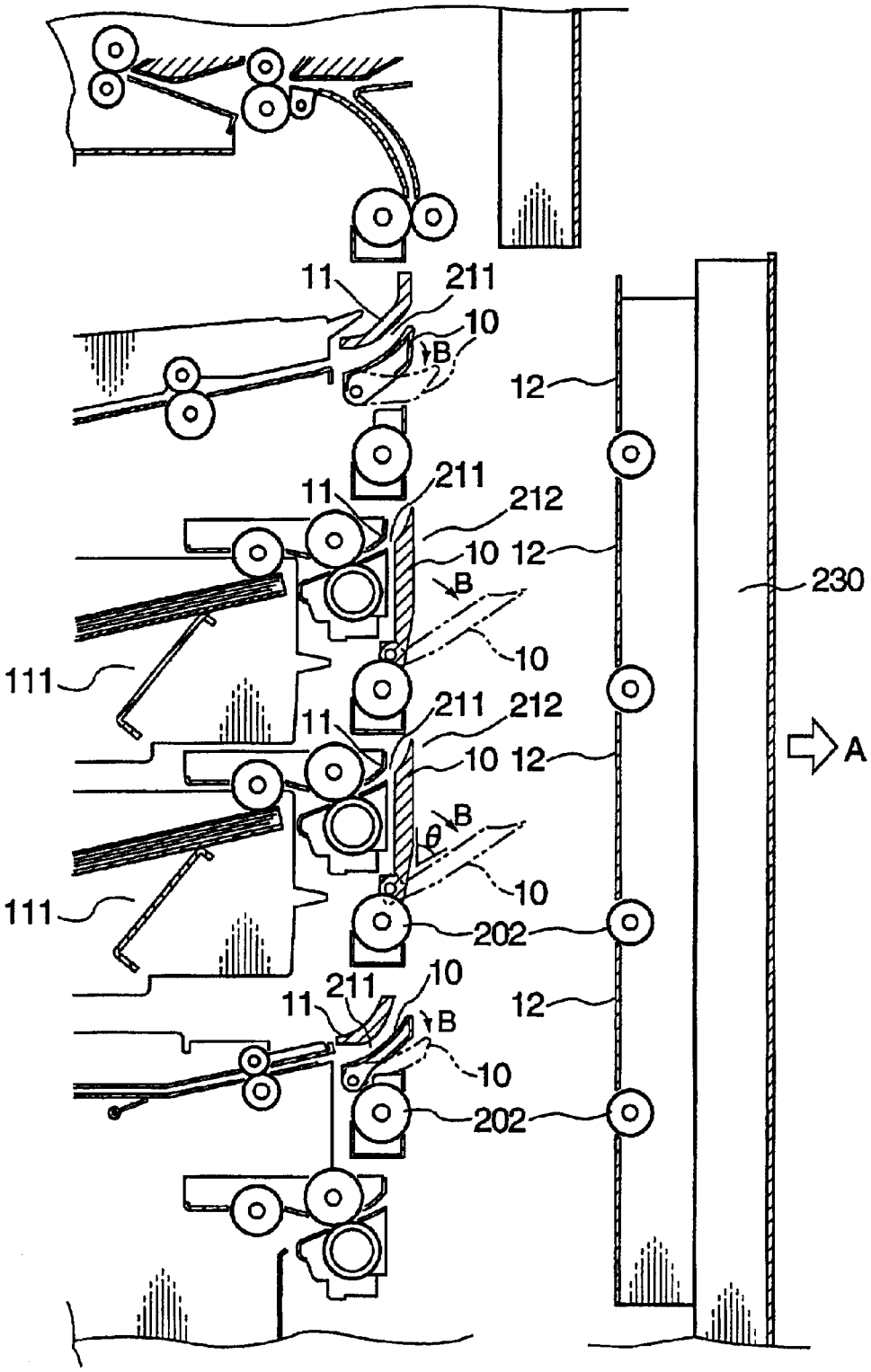
FIG. 3 is a sectional view of the sheet transport device and its vicinity shown in FIG. 1, specifically showing a state that the side door is opened.

FIGS. 2 and 3 are sectional views of the sheet transporting section 200 and its vicinity in accordance with the embodiment of this invention. FIG. 2 shows a state that a side door 230 of the copier is closed, and FIG. 3 shows a state that the side door 230 is opened. FIG. 4 is a sectional view showing essential parts of the sheet transporting section 200 including a guide member. Elements of the essential parts constituting the sheet transporting section 200 which are identical to those of the conventional copier shown in FIGS. 15 to 16B are denoted at the same reference numerals, and a description thereof is omitted herein.

Each guide member 10 shown in FIG. 2 is made of a transparent synthetic resin. A first sheet transport path 211 is defined by an inner surface (one surface) of the guide member 10 and an outer surface (one surface) of a first counterpart member 11. Likewise, a second sheet transport path 212 is defined by an outer surface (opposite surface) of the guide member 10 and an inner surface 12 of the side door (second counterpart member) 230 opposing the guide member 10. The guide member 10 is mounted at such a position relative to a frame of a copier main body as to allow the guide member 10 to define the first sheet transport path 211 and the second sheet transport path 212 each having a certain width when the side door 230 is closed and the guide member 10 is set at a closed position.

The guide member 10 is pivotally rotatable about an axis of a rotary shaft 10*a*. As shown in FIG. 4, a spring member 15 partially having an arc shape is provided along a circumference of the rotary shaft 10*a* of the guide member 10. The spring member 15 has one end portion 15*a* abutted against an outer surface on a base portion of the guide member 10, and the opposite end portion 15*b* abutted against a spring support member 16 to urge the guide member 10 toward the closed position. The spring member 15 and the spring support member 16 constitute retaining means of this invention.

Hereafter, a jammed sheet removal operation from the first and second sheet transport paths for use with the sheet transport device in accordance with the embodiment of this invention is described.

First, when the side door 230 is opened in the direction of the arrow A in FIG. 3, and the second sheet transport path 212 is exposed, an operator is ready to remove a jammed sheet from the second sheet transport path 212 (see FIG. 3). At this time, the guide member 10 is kept at the closed position as shown by the solid lines in FIGS. 3 and 4. Since the guide member 10 is made of a transparent material, the operator can see the first sheet transport path 211 through the guide member 10 so as to verify whether there is a jammed sheet in the first sheet transport path 211.

Figure 4:
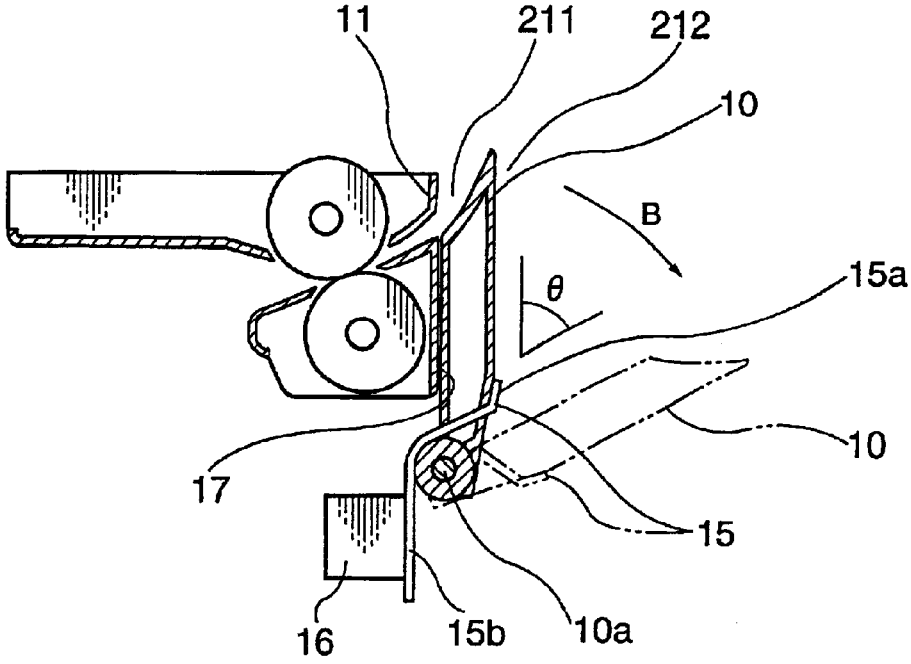
FIG. 4 is a sectional view showing essential parts of the sheet transport device including a guide member in the embodiment of this invention.

Next, when the operator pivotally rotates the guide member 10 in the direction of arrow B in FIG. 3 to expose the first sheet transport path 211 and sets guide member 10 at an opening angle of e.g., 60° with respect to a vertical plane of the copier, as shown by the broken lines in FIGS. 3 and 4, the operator can remove a jammed sheet from the first sheet transport path 211. When the guide member 10 is set to the opened position, the spring member 15 resiliently deforms as shown by the broken line in FIG. 4. When the operator releases the guide member 10 after removing a jammed sheet, the guide member 10 is returned to the closed position due to a restoring force of the spring member 15.

In FIG. 4, the rotary shaft 10*a* of the guide member 10 is located at a lower part with respect to the first sheet transport path 211. With this arrangement, a greater space is secured for the first sheet transport path 211 when the guide member 10 is set to the opened position even if the opening angle of the guide member 10 is as small as 20 to 30°. In this state, an operator can easily remove a jammed sheet from the first sheet transport path 211. If the opening angle of the guide member 10 exceeds 40°, the first sheet transport path 211 is opened wide to thereby enable an operator to remove a jammed sheet much more easily.

The guide member 10 is constantly urged toward the closed position due to a biasing force of the spring member 15. A rotation stopper member (not shown) is mounted on the rotary shaft 10*a* of the guide member 10 to retain the guide member 10 at a specified angular position (closed position). It may be preferable to retain the guide member 10 at the closed position by allowing the inner surface on the base portion of the guide member 10 to abut against an opposing member 17.

As mentioned above, operations of the guide member 10 are not associated with open/close operations of the side door 230, and accordingly, there is no likelihood that the guide member 10 may be abutted against the inner wall of the side door 230 which may result in damage of the guide member 10 and/or the side door 230. Further, this arrangement is free from pressing of the guide member 10 by the inner wall of the side door 230 as having been encountered in the conventional sheet transport device. Accordingly, this arrangement enables to secure the opening angle of the guide member 10 as wide as possible. For example, it may be possible to set the opening angle θ of the guide member 10 at 90° or larger (in FIG. 4, the opening angle can be set at as large as 180°). In the case where the plane of the guide member 10 for defining the first sheet transport path 212 extends close to the rotary shaft 10*a*, there may not be secured a sufficient space for exposing the first sheet transport path 211 if the opening angle of the guide member 10 is set small. However, since this arrangement enables to set the opening angle of the guide member 10 as large as possible, operability of an operator in removing a jammed sheet is improved.

Also, since the guide member 10 is automatically set to the closed position by a restoring force of the spring member 15, there is no likelihood that an operator may inadvertently close the side door 230 while leaving the guide member 10 in an opened state.

<First Modification>

Figure 5:
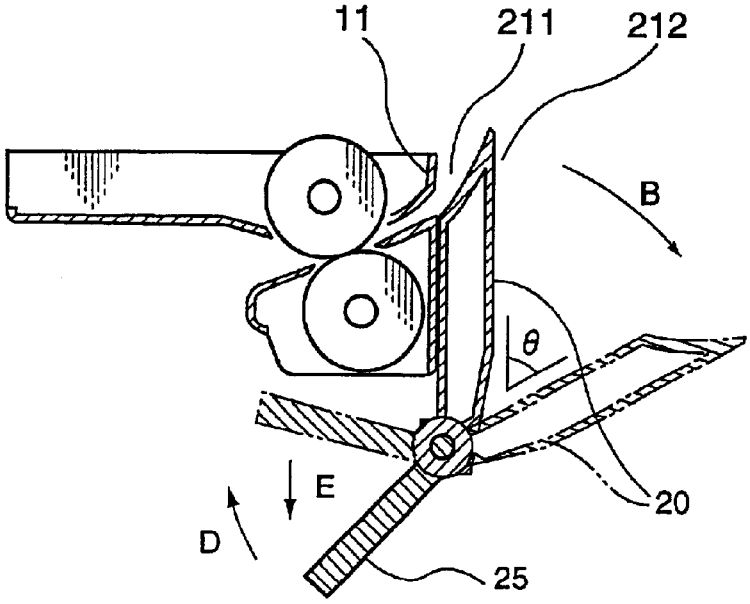
FIG. 5 is a sectional view showing essential parts of a sheet transport device including a guide member as a first modification of the embodiment of this invention.

FIG. 5 is a sectional view showing essential parts of a sheet transport device including a guide member and its peripheral elements as a first modification of the embodiment of this invention. The arrangement of the first modification except the guide member and its peripheral elements is identical to that of the embodiment, and accordingly, elements of the modification which are identical to those of the embodiment are denoted at the same reference numerals, and a description thereof is omitted herein.

A guide member 20 in the first modification is provided with a weight 25 to retain the guide member 20 at a closed position by its weight. The weight 25 corresponds to the retaining means of this invention.

First, an operator manually opens the guide member 20 in the direction of the arrow B in FIG. 5 to expose a first sheet transport path 211. In FIG. 5, when the guide member 20 is set at an opened position, the guide member 20 and a vertical plane define an opening angle θ=60°, as shown by the broken line in FIG. 5. In this state, the weight 25 is raised in the direction of the arrow D in FIG. 5. When the operator releases his or her hand from the guide member 20 after removing a jammed sheet from the first sheet transport path 211, the weight 25 is lowered by its weight in the direction shown by the arrow E in FIG. 5. As the weight 25 is lowered, the guide member 20 is set to a closed position shown by the solid line in FIG. 5. In this modification, similar to the embodiment, a jammed sheet can be removed as far as the guide member 20 is kept at an opening angle of 20° or larger. Setting the opening angle at 40° or larger enables to facilitate removal of a jammed sheet. It may be possible to set the opening angle of the guide member 20 close to 180° depending on the mounting position of the weight 25.

Similar to the embodiment, the arrangement in this modification enables to set the opening angle θ of the guide member 20 as large as possible without a likelihood that the guide member 20 may be abutted against the inner wall of the side wall 230 which may result in damage of the side wall 230 and/or the guide member 20. Further, since this arrangement enables to automatically close the guide member 20, there is no likelihood that the side door 230 may be closed before the guide member 20 is completely closed.

<Second Modification>

Figure 6A:
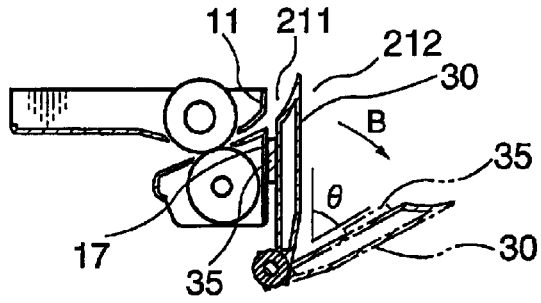
FIG. 6A is a sectional view showing essential parts of a sheet transport device including a guide member as a second modification of the embodiment of this invention.
Figure 6B:
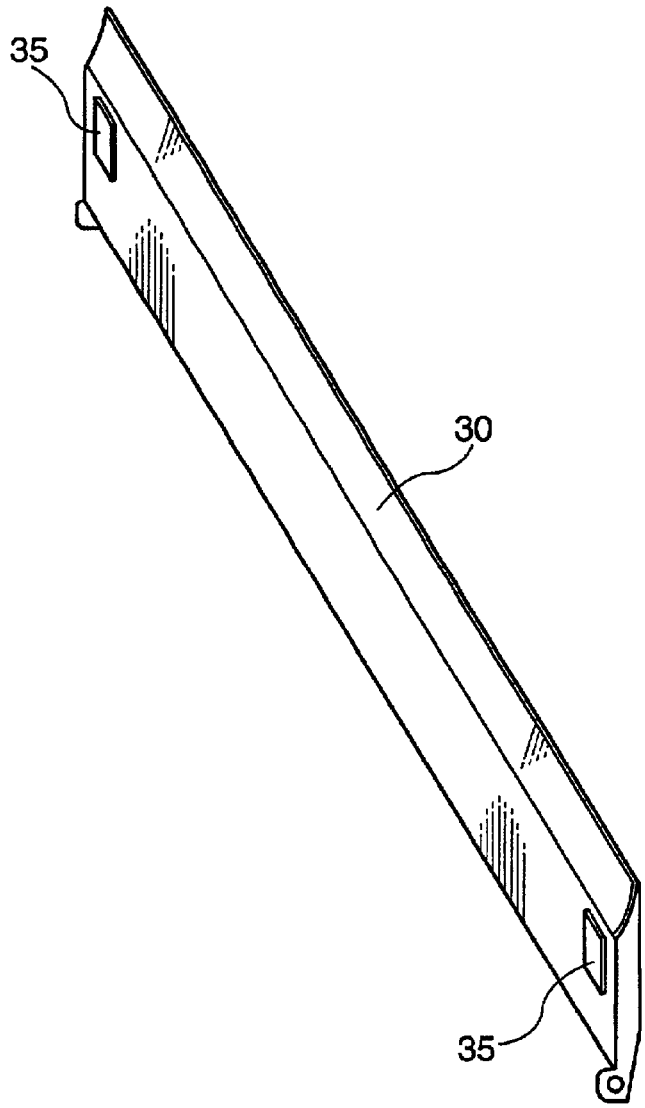
FIG. 6B is a perspective view of the guide member shown in FIG. 6A.

FIG. 6A is a sectional view of essential parts of a sheet transport device including a guide member and its peripheral elements as a second modification of the embodiment of this invention. FIG. 6B is a perspective view of the guide member shown in FIG. 6A. The arrangement of this modification except the guide member and its peripheral elements is identical to that of the embodiment, and accordingly, elements of the modification which are identical to those of the embodiment are denoted at the same reference numerals, and a description thereof is omitted herein.

In the second modification, a magnet 35 is attached to a guide member 30. An opposing member 17 of steel is magnetically attracted to the magnet 35 to securely set the guide member 30 to a closed position.

An operator manually opens the guide member 30 in the direction of the arrow B in FIG. 6A to set the guide member 30 to a posture shown by the broken line in FIG. 6A, whereby a first sheet transport path 211 is exposed. As the operator manually returns the guide member 30 to the closed position after removing a jammed sheet from the first sheet transport path 211, the magnet 35 is magnetically attracted to the opposing member 17, thereby securely setting the guide member 30 to the closed position.

Similar to the embodiment, this modification enables to set the opening angle θ of the guide member 30 as large as possible since there is no likelihood that the guide member 30 is abutted against the inner wall of a side door 230.

<Third Modification>

Figure 7:
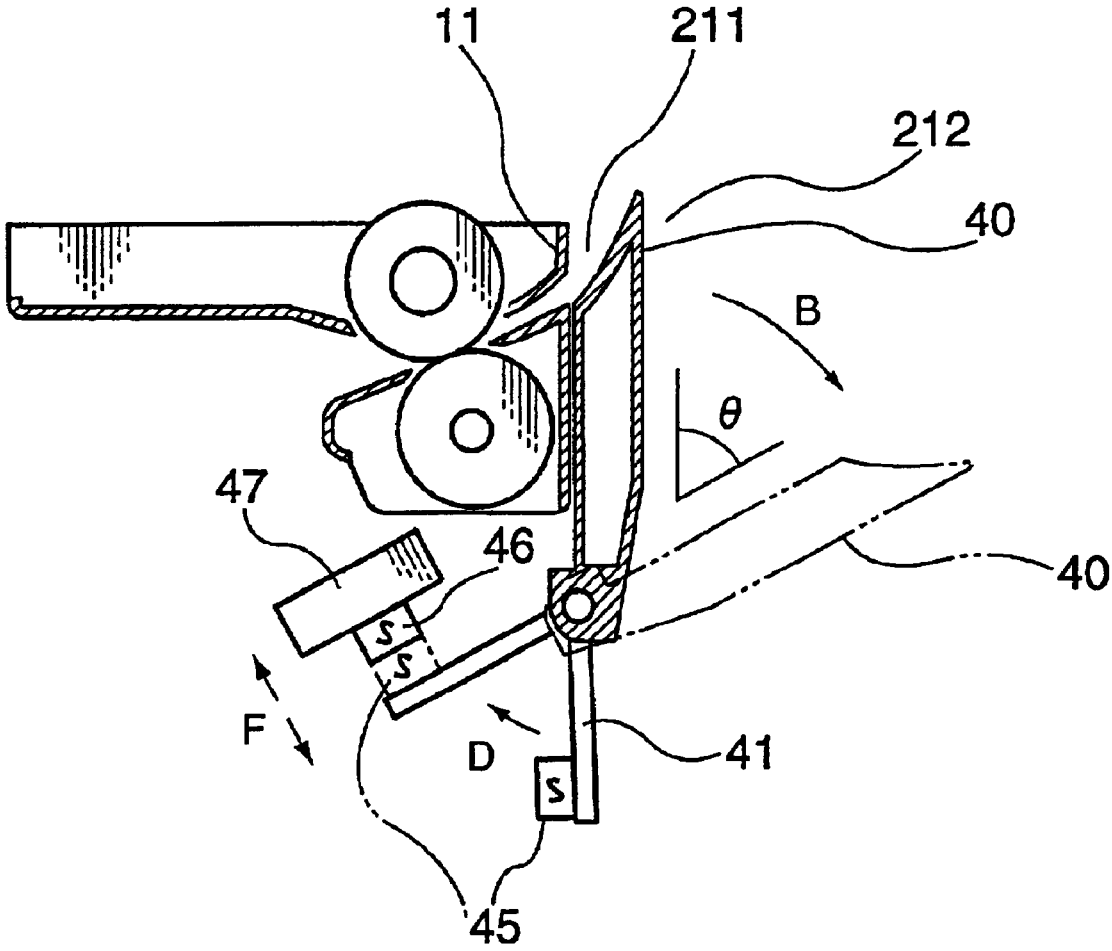
FIG. 7 is a sectional view showing essential parts of a sheet transport device including a guide member as a third modification of the embodiment of this invention.

FIG. 7 is a sectional view of essential parts of a sheet transport device including a guide member and its peripheral elements as a third modification of the embodiment of this invention. The arrangement of this modification except the guide member and its peripheral elements is identical to that of the embodiment, and accordingly, elements of the modification which are identical to those of the embodiment are denoted at the same reference numerals, and a description thereof is omitted herein.

A magnet 45 having a south pole is attached to an extension 41 of a guide member 40. A counterpart magnet 46 having a south pole is attached to such a position of an element 47 as to come into contact with the magnet 45 when the guide member 40 is set to an opened position. In FIG. 7, the element 47 is a base member on which the counterpart magnet 46 is mounted. The base member 47 is fixedly secured on a frame of a main body of a copier.

When the guide member 40 is set to an opened position as shown by the arrow B in FIG. 7, the magnet 45 comes closer or comes into contact with the counterpart magnet 46 in the direction of the arrow D in FIG. 7, as shown by the broken line in FIG. 7. Since the magnet 45 and the counterpart magnet 46 have the same polarity (south pole), the magnet 45 and the counterpart magnet 46 are apt to be repulsive against each other. However, an operator can remove a jammed sheet from a first sheet transport path 211 by holding the guide member 40 with his or her hand and opening the guide member 40. Releasing the hand after removing a jammed sheet enables to return the guide member 40 to a closed position in the direction of the arrow F in FIG. 7 aided by a repulsing force of the magnet 45 against the counterpart magnet 46.

Similar to the embodiment, the third modification enables to securely set the opening angle θ of the guide member 40 as large as possible without a likelihood that abutment of the guide member 40 against the inner wall of a side door 230 leads to damage of the guide member and the side door 230. Further, since the guide member 40 is automatically closed in this modification, there is no likelihood that the side door 230 may be closed while leaving the guide member 40 open.

<Fourth Modification>

FIGS. 8A to 8E are diagrams showing a guide member and its peripheral parts provided in a sheet transport device as a fourth modification of this invention.

Figure 8E:
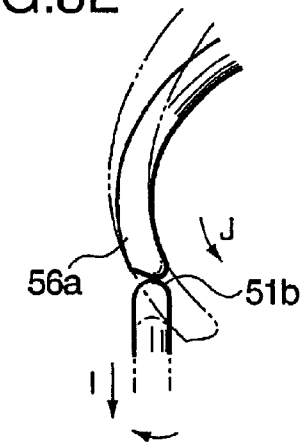
FIGS. 8A to 8E are diagrams showing a guide member and its peripheral parts in a sheet transport device as a fourth modification of the embodiment of this invention.
Figure 8A:
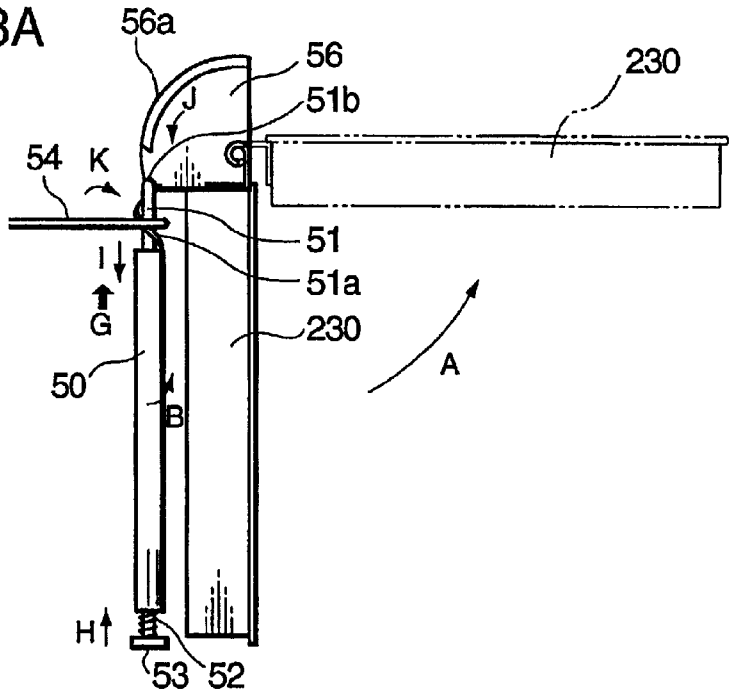
Figure 8C:
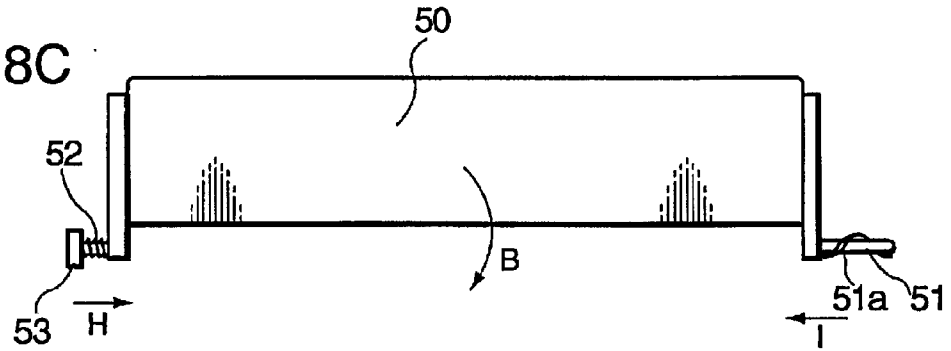
Figure 8B:
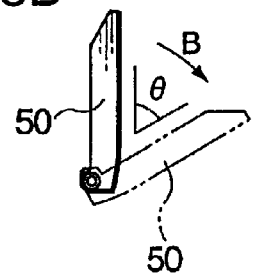

FIG. 8A is a diagram showing operations of the guide member 50 in association with open/close operations of a side door 230 viewed from above. FIG. 8B is a diagram of the guide member 50 viewed from a side thereof, and FIG. 8C is a diagram showing operations of the guide member 50 viewed from the side door 230.

The guide member 50 is integrally rotatable with an axis of a rotary shaft 51, 52 (hereinafter also referred to as "a guide member shaft"). The rotary shaft 51, 52 has one end portion formed into a spiral portion 51 including a spiral rib 51*a*, and the opposite end portion provided with a coil spring (biasing means) 52. The coil spring 52 is supported on a support base 53 provided at the opposite end of the rotary shaft and is urged toward the spiral portion 51, namely, in the direction of the arrow H in FIG. 8A.

Figure 8D:
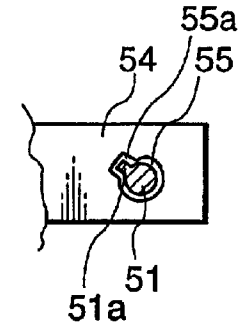

FIG. 8D is a diagram of a guide support member 54 (also referred to as "a spiral guide member") and the spiral portion 51 viewed from the direction of the arrow G in FIG. 8A. As shown in FIG. 8D, the spiral portion 51 is inserted in a hole (guide portion) 55 formed in the guide support member 54 in such a manner that the spiral rib 51*a* of the spiral portion 51 is slidably engaged in a recess 55*a* of the hole 55. The guide support member 54 is fixed to a frame of a main body of a copier.

The guide member 50 integrally rotatable with the rotary shaft (guide member shaft) having the aforementioned structure is linked via the spiral portion 51 to the guide support member (spiral guide member) 54 fixed to the copier main body frame.

A fan member 56 is mounted on one axial end of a rotary shaft having an axis about which the side door 230 pivotally swings or rotates. A pressing portion 56*a* is formed on a peripheral portion of the fan member 56. FIG. 8E is a diagram illustrating a relation between a lead end 51*b* of the rotary shaft of the guide member 50 and the fan member 56. As shown in FIG. 8E, the pressing portion 56*a* of the fan member 56 is adapted to press the lead end 51*b* of the rotary shaft of the guide member 50 in the direction of the arrow I (direction toward the opposite end of the rotary shaft of the guide member 50). The side door 230 has an axis of rotation (also referred to as "a second axis") thereof extending in a transverse direction of the copier, namely, in a direction orthogonal to the axis of rotation (also referred to as "a first direction") of the rotary shaft of the guide member 50 to be vertically openable.

Next, operations of the guide member 50 in association with opening/closing of the side door 230 are described.

When the side door 230 is opened in the direction of the arrow A in FIG. 8A, the fan member 56 is pivotally rotated in the direction of the arrow J in FIG. 8A and FIG. 8E. The pressing portion 56*a* of the fan member 56 presses the lead end 51*b* of the rotary shaft of the guide member 50 in the direction of the arrow I accompanied by the pivotal rotation of the fan member 56 (see FIGS. 8A and 8E). As the guide member 50 is pressed in the direction of the arrow I in FIGS. 8A and 8C, the spiral portion 51 slides in the direction of I through the hole 55 of the guide support member 54. At this time, since the spiral portion 51 slides through the hole 55 in a state that the spiral rib 51*a* of the spiral portion 51 slides along the recess 55*a*, the rotary shaft of the guide member 50 rotates about the axis thereof in the direction of the arrow K (see FIGS. 8A and 8D). As a result, the guide member 50 rotates about the axis thereof in the direction of the arrow B in FIG. 8C to be set to the opened position. When the side door 230 is opened at an angle of 90° relative to a vertical plane, the opening angle θ of the guide member 50 relative to a vertical plane is, e.g., set at 60°.

On the other hand, when the side door 230 is closed, the pressing portion 56*a* of the fan member 56 releases pressing thereof against the lead end 51*b* to thereby rotate the guide member 50 in the direction of the arrow B in FIG. 8C about the axis of the rotary shaft thereof. Thereby, the guide member 50 is pressed in the direction of the arrow H opposite to the direction I by a restoring force of the coil spring 52, and the spiral portion 51 slidingly moves through the hole 55 in a state that the spiral rib 51*a* of the spiral portion 51 slides along the recess 55*a* in the direction of the arrow I to rotate the guide member 50 about the axis of the rotary shaft thereof in the direction opposite to the direction K to thereby set the guide member 50 to the closed position.

It should be noted that the spiral portion 51, the guide support member 54 and the biasing means 52 together form a motion conversion mechanism which basically converts the rotational motion of the side door 230 about the second axis (vertical axis) to the rotational motion of the guide member 50 about the first axis (horizontal axis). In addition, the pressing portion 56*a* of the fan member 56 can be included to form the motion conversion mechanism.

In the fourth modification, the guide member 50 is opened and closed in association with opening/closing of the side door 230 as mentioned above. In this modification, since there is no likelihood that the guide member 50 may be abutted against the inner wall of the side door 230, the side door 230 and the guide member 50 are free from damage and/or loss thereof. This modification also enables to secure the opening angle θ of the guide member as wide as possible. It is preferable to form a moderate curve on the spiral rib 51*a* (namely, form spirals at a large stroke) in view of the fact that generally the opening angle of the guide member does not exceed 90° and accordingly, the turning angle of the spiral rib 51*a* is not required to be large. With this arrangement, the guide member 50 is rotatable with a small external force.

<Fifth Modification>

Figure 9:
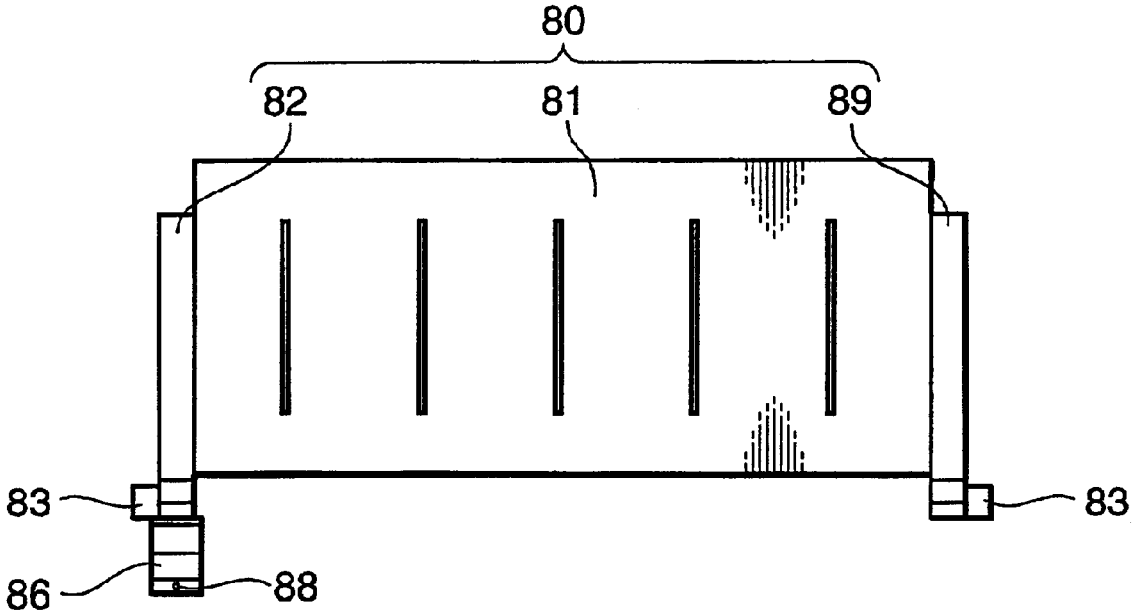
FIG. 9 is a diagram showing a guide member and retaining means provided in a sheet transport device as a fifth modification of the embodiment of this invention.
Figure 10A:
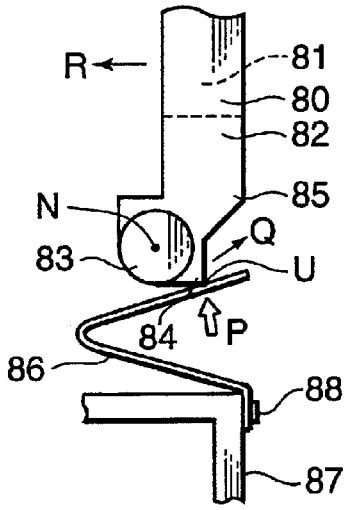
FIGS. 10A to 10*c* are side views showing operations of the retaining means and peripheral parts around a rotary shaft (also referred to as a guide member shaft) of the guide member in the sheet transport device of the fifth modification.
Figure 10B:
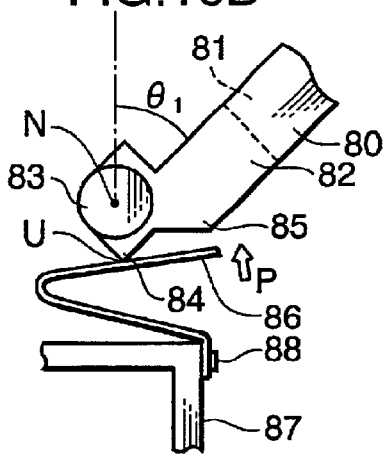
Figure 10C:
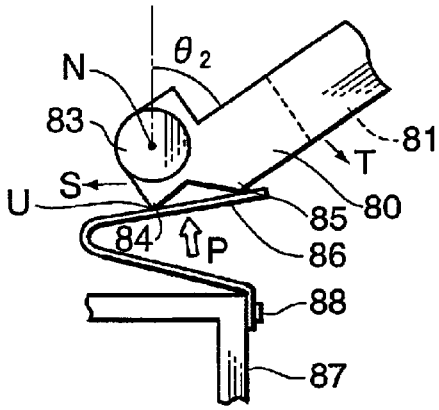

FIGS. 9 to 10C are diagrams showing a guide member and its peripheral parts provided in a sheet transport device as a fifth modification of this invention. FIG. 9 is a plan view of the guide member and retaining means provided in a sheet transport device 200 viewed from a side door of a copier. FIGS. 10A to 10C are side views showing the retaining means and peripheral parts of a rotary shaft of the guide member. FIG. 10A shows a state that the guide member is set at a closed position, FIG. 10B shows a state that the guide member is located at a certain intermediate position between the closed position and an opened position, and FIG. 10C shows a state that the guide member is set at the opened position. The other elements of the fifth modification are the same as those of the embodiment.

The guide member 80 includes a planar plate portion 81, and arm portions 82, 89 jointed to opposite lateral ends of the plate portion 81, respectively. The guide member 80 is pivotally rotatable between a closed position and an opened position about an axis of the rotary shaft 83 each provided at a lower portion of the arm portion 82 (89). Each rotary shaft 83 is rotatably mounted on a frame (not shown) of a main body of the copier.

As shown in FIG. 10A, a first projected portion 84 and a second projected portion 85 are formed each at a lower part of the arm portion 82 in such a manner that the projected portion 84 (85) protrudes radially outwardly from a center of axis N of rotation of the guide member 80.

A metallic plate spring (biasing member) 86 is provided in contact with the first projected portion 84. One end of the plate spring 86 is fixed to a frame 87 of the copier main body by fastening means 88. The plate spring 86 has a generally V-shape and is constantly urged in such a direction (in the direction of the arrow P in FIGS. 10A to 10C) as to press the first projected portion 84.

Now, operations of the guide member 80 having the above construction are described with reference to FIGS. 10A to 10C.

As shown in FIG. 10A, when the guide member 80 is set at the closed position, a line UN connecting a contact point U of the first projected portion 84 and the plate spring 86 and the center of axis N does not make agreement with the direction of the arrow P. In this state, the first projected portion 84 is pressed in the direction of the arrow Q in FIG. 10A by the urging force of the plate spring 86. As a result, the planar portion 81 of the guide member 80 is urged in the direction of the arrow R in FIG. 10A, namely, toward the closed position, thereby retaining the guide member 80 at the closed position.

While the guide member 80 is pivotally rotated from the closed position toward an opened position until the guide member 80 reaches a state just before the intermediate position, the planar portion 81 of the guide member 80 starts to be urged toward the closed position.

Subsequently, when the guide member 80 reaches the intermediate position (e.g., opening angle $\theta_1$=45°) (see FIG. 10B), the line UN connecting the contact point U and the center of axis N makes agreement with the direction P along which the plate spring 86 is pressed. Thereby, the guide member 80 is brought to a state that the plate spring 86 is bendable at a maximal value by the first projected portion 84 (namely, a state that the urging force of the plate spring 86 is maximal). Further pivotal rotation of the guide member 80 toward the opened position displaces the line UN from the direction P. As a result, the first projected portion 84 is urged in the direction of the arrow S in FIG. 10C by the urging force of the plate spring 86 directed in the direction of the arrow P. Thereby, the guide member 80 is urged toward the opened position (in the direction of the arrow T in FIG. 10C). In this way, the guide member 80 is urged toward the opened position while pivotally rotated from the intermediate position to the opened position. While the guide member 80 is urged toward the opened position, as shown in FIG. 10C, since the second projected portion (rotating restricting means) 85 is rendered in contact with the plate spring 86, the guide member 80 is kept from being further pivotally rotated beyond the opened position, and is retained at a certain opening angle (e.g., opening angle $\theta_2$=60°) (namely, set to the opened position).

The opening angle (maximal openable angle) $\theta_2$ corresponding to the opened position of the guide member 80 can be optimally varied by changing the projection height and the position of the second projected portion 85. Further, changing the position of the first projected portion 84 enables to change the opening angle $\theta_1$ corresponding to the intermediate position of the guide member 80. For instance, the position of the first and second projected portions 84, 85 may be changed such that the opening angle $\theta_2$ is 60° and the opening angle $\theta_1$ is 55°. In this case, the guide member 80 is urged toward the closed position to such an extent that the guide member 80 is pivotally rotatable almost close to the normally maximally openable position. Alternatively, the position of the first and second projected portions 84, 85 may be changed such that the opening angle $\theta_2$ is 70° and the opening angle $\theta_1$ is 15°. In this case, exerting a small external force to open the guide member 80 enables to automatically set the guide member 80 to the opened position.

As mentioned above, in the fifth modification, the guide member 80 is automatically urged to the closed position upon reaching the intermediate position, and is retained at the closed position. This arrangement facilitates jammed sheet removal operation from a first sheet transport path without manually holding of the guide member 80 with an operator's hand. After the jammed sheet removal operation, the guide member 80 is automatically set to the closed position upon tilting the guide member 80 toward the closed position beyond the intermediate position without completely setting the guide member 80 to the closed position. This arrangement simplifies open/close operations of the guide member 80 by an operator.

As mentioned above, the sheet transport device according to this invention is described with reference to the aforementioned drawings. The following modifications and alterations are applicable as far as such modifications and alterations do not depart from the gist of the invention.

In the first modification, the guide member is provided with a weight. Alternatively, a guide member may be set to a closed position by simply adjusting balance of the weight of the guide member itself.

In the embodiment and the modifications, the entirety of the guide member is made of a transparent synthetic resin. Alternatively, part of the guide member may be made of a transparent synthetic resin (or transparent glass or its equivalent). As a further altered form, a guide member may be formed with an opening through which an operator can view the first sheet transport path. In such a case, the opening may be one or more than one.

Figure 13A:
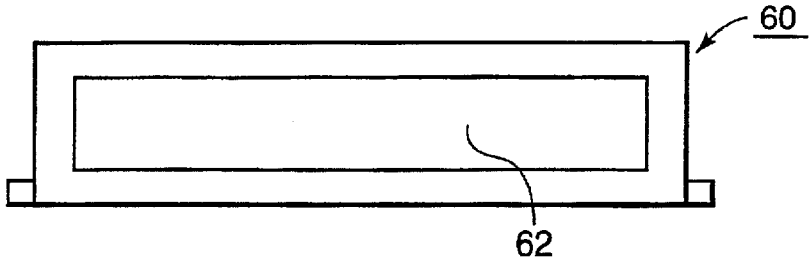
FIGS. 13A to 13F are diagrams for illustrating altered forms of the guide member incorporated in the sheet transport device of this invention, specifically showing configurations thereof viewed from a second counterpart member of this invention.
Figure 13B:
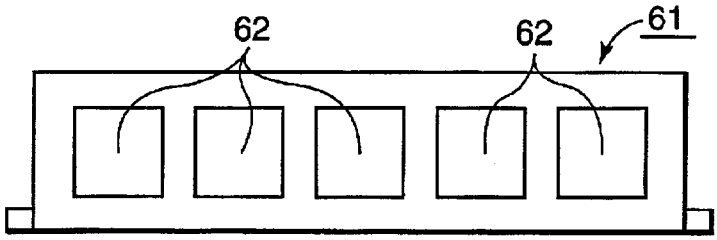
Figure 13C:
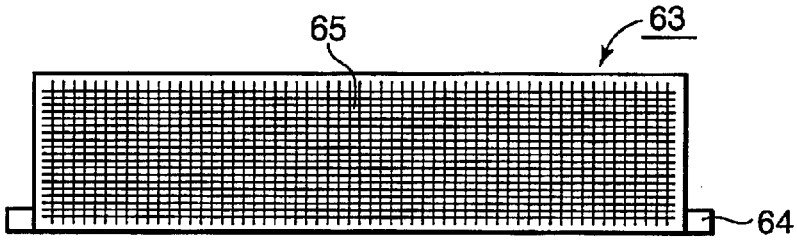
Figure 13D:
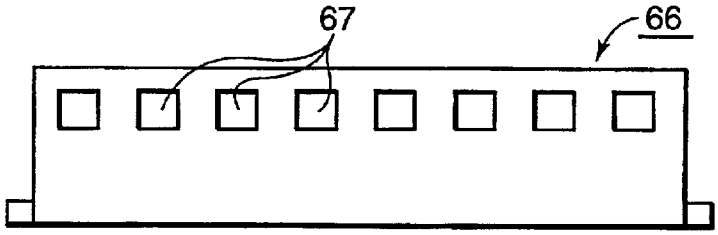
Figure 13E:
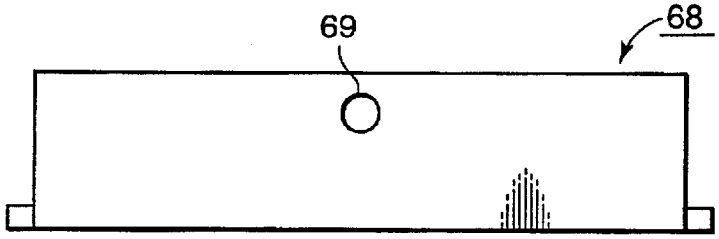
Figure 13F:
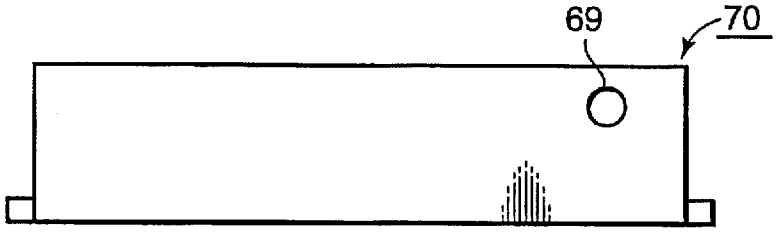

Alternatively, the guide member may include a mesh portion. FIGS. 13A through 13F are diagrams of alterations of the guide member to be incorporated in a sheet transport device of this invention viewed from a second counterpart member (e.g., side door). Specifically, as shown in FIGS. 13A (13B), one (or more than one window portion) 62 may be formed in a guide member 60 (61). Alternatively, the window portion 62 in the guide member 60 in FIG. 13A and the window portions 62 in the guide member 61 in FIG. 13B may be made of Ma transparent synthetic resin. As a further altered arrangement, as shown in FIG. 13C, a guide member 63 may include a mesh portion 65 (portion other than a shaft 64 for mounting the guide member). As a further altered form, as shown in FIG. 13D, a guide member 66 may be formed with plural square cutaways 67. Alternatively, as shown in FIGS. 13E (13F), a guide member 68 (70) may be formed with one circular opening 69. It is preferable to form the opening 69 transversely in the middle of the guide member 68 as shown in FIG. 13E in the case where a sheet is transported in a sheet transport path having a transversely mid point as a reference point for sheet transport. On the other hand, it is preferable to form the opening 69 in a right (or left) side of the guide member 70 as shown in FIG. 13F in the case where a sheet is transported in a sheet transport path having a right (left) side thereof as a reference side. However, it is preferable to form the entirety of a guide member of a transparent material or to form an opening or a transparent section in the guide member 60 (61, 63, or 66) over its widthwise entirety of a sheet transport path, as shown in FIGS. 13A (13B, 13C, or 13D) in light of convenience that an operator can easily recognize that part of a sheet is torn away and stuck in the sheet transport path or a sheet is jammed in the sheet transport path when the guide member is set to a closed position.

In the fourth modification, the state in which the coil spring 52 mounted on the guide member 50 is urged in the direction of the arrow H in FIG. 8C by a restoring force thereof is set as a closed position of the guide member. Alternatively, the aforementioned state may be set as an opened position of the guide member.

The biasing means may include an elastic member made of a rubber or its equivalent as well as the coil spring as exemplified in the fourth modification.

Figure 14:
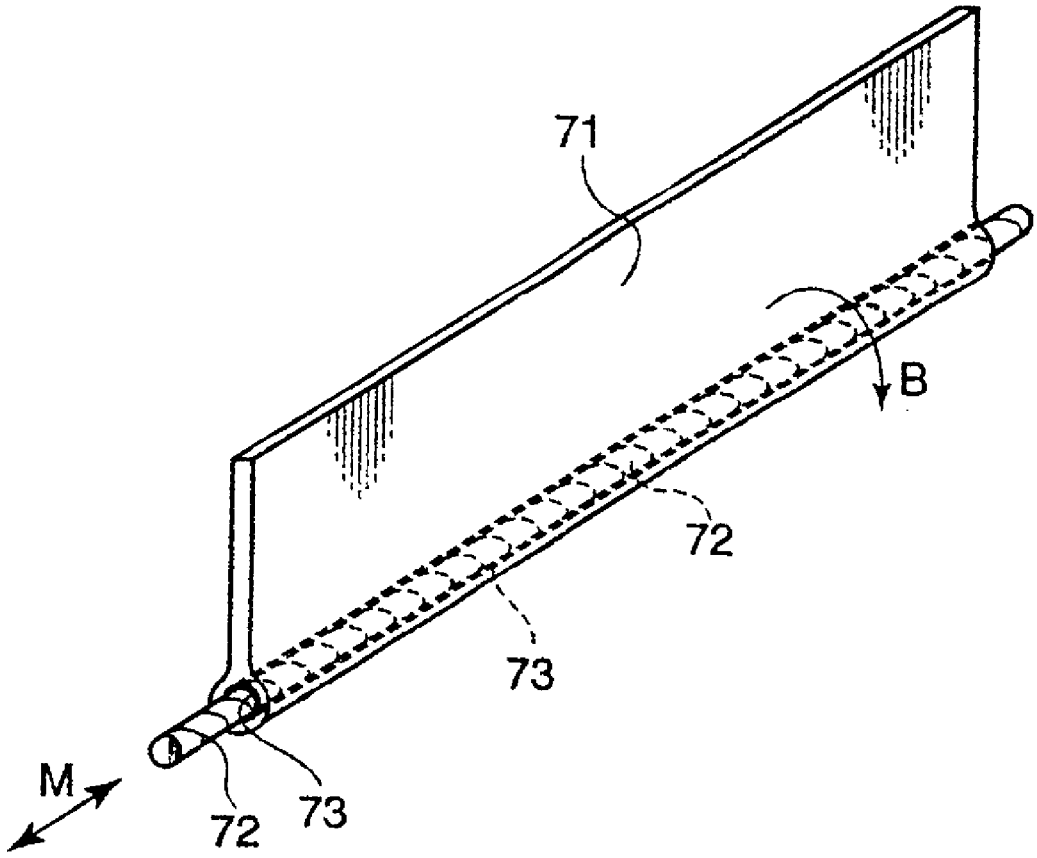
FIG. 14 is a perspective view showing an altered form of the guide member and a rotary shaft (also referred to as a guide member shaft) for rotating the guide member in the sheet transport device of this invention.

In the fourth modification, the guide member and the rotary shaft for rotating the guide member are formed as a one-piece unit. Alternatively, the guide member and the rotary shaft may be fabricated individually. In the case where the guide member and the rotary shaft are made individually, for example, as shown in FIG. 14, which is a perspective view showing an altered arrangement of the guide member and the rotary shaft in the sheet transport device of this invention, a rotary shaft 72 is slidably inserted in a hole 73 formed coaxially with an axis of rotation of a guide member 71. The rotary shaft 72 is formed with a spiral groove in the surface thereof. A corresponding spiral portion to be meshed with the spiral groove of the rotary shaft 72 is formed in the inner wall of the hole 73 of the guide member 71.

With this arrangement, as the rotary shaft 72 slidably moves in the axial direction, namely, in the directions of the arrows M in FIG. 14, the spiral groove in the rotary shaft 72 and the spiral portion in the inner wall of the hole 73 spirally mesh with each other. Thereby, the guide member 71 is pivotally rotated to the opened position and the closed position. In the aforementioned arrangement in which the guide member 71 and the rotary shaft 72 are rotatably engaged with each other by way of the spiral portion of the guide member 71 and the spiral groove in the rotary shaft 72, the guide member 71 is prevented from moving in the axial direction of the rotary shaft.

Figure 11A:
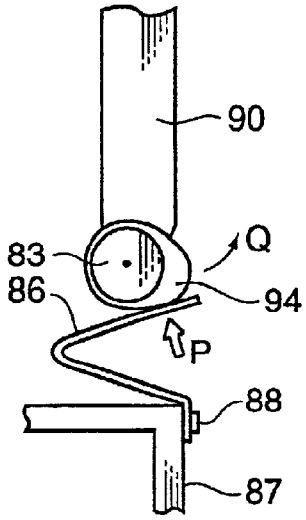
FIGS. 11A to 11C are side views showing operations of altered retaining means in the sheet transport device of the fifth modification.
Figure 11B:
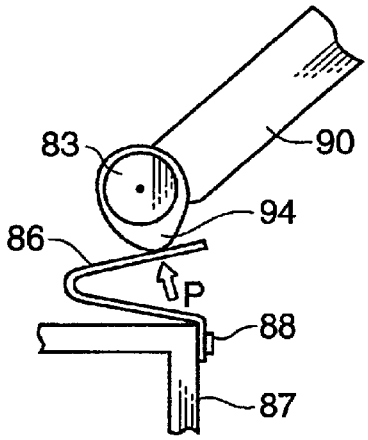
Figure 11C:
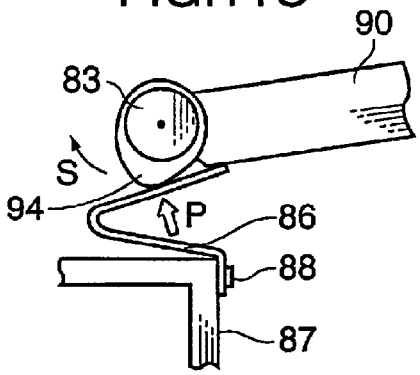

In the fifth modification, the first projected portion 84 serving as a projected portion of the retaining means has a corner portion having a certain angle. Alternatively, as shown in FIGS. 11A to 11C, the projected portion of the retaining means may have a curved portion. FIG. 11A shows a state that a guide member 90 is set to a closed position, FIG. 11B shows a state that the guide member 90 is located at a certain intermediate position between the closed position and an opened position, and FIG. 11C shows a state that the guide member 90 is set to the opened position. In the alteration shown in FIGS. 11A to 11C, a curved projected portion 94 may have such a configuration that a lead end of the projected portion is not constantly rendered in contact with a plate spring (biasing means) 86. The projected portion may be configured optimally depending on how much external force is to be applied to the guide member 90 in an attempt to open and close the guide member 90.

Figure 12:
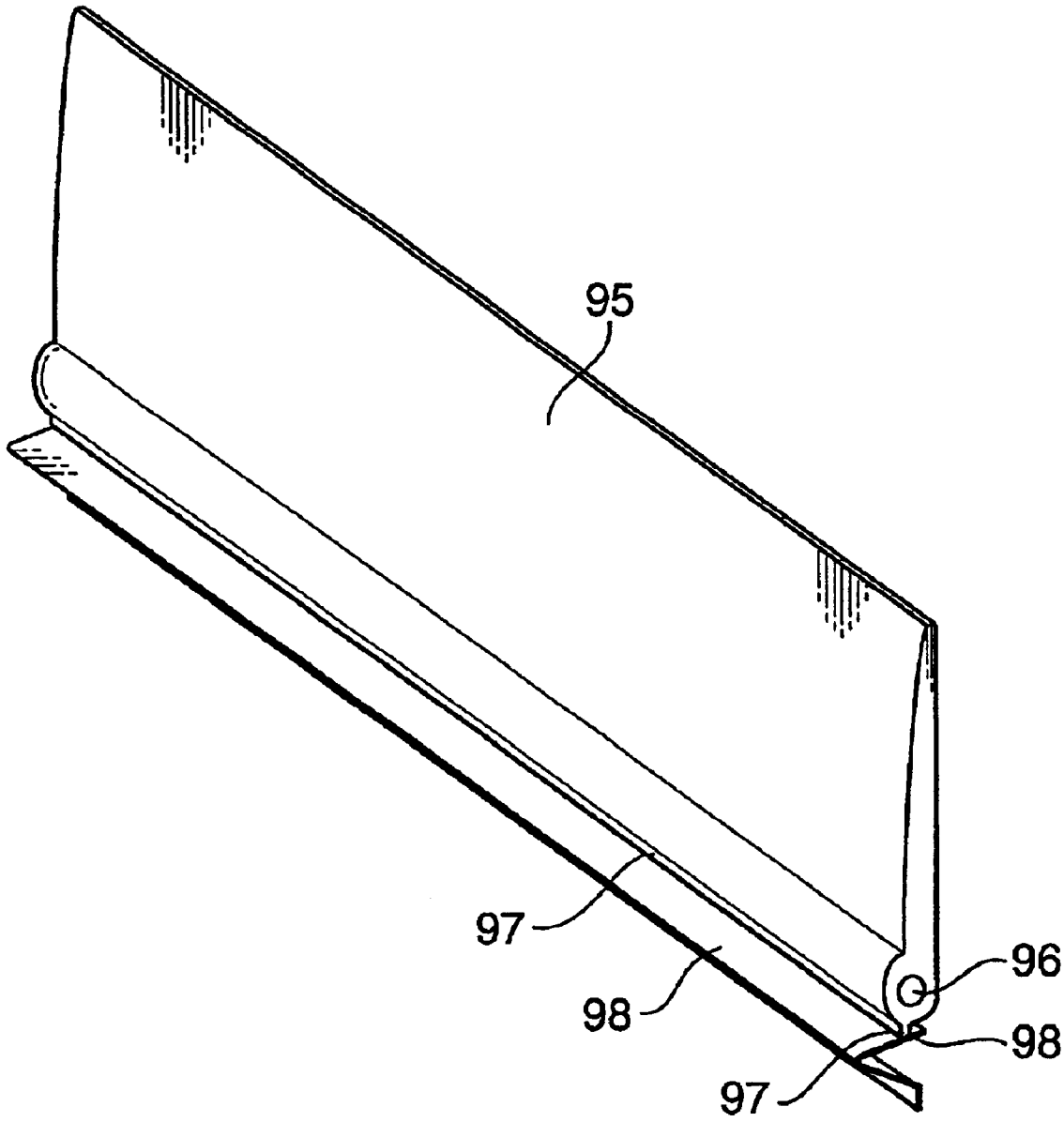
FIG. 12 is a perspective view showing a further altered arrangement of the guide member and the retaining means of the sheet transport device in the fifth modification.

In the fifth modification, the spring plate 86 in a bent form serves as the biasing member to be incorporated in the retaining means. Alternatively, the biasing member may include a compression spring or its equivalent. In the fifth modification, the biasing member (plate spring 86) is provided on the arm portion 82 of the guide member 80. Alternatively, each one of the arm portions 82, 89 may be provided with a biasing member. In the case where a biasing member is provided on either one of the arm portions 82, 89, the biasing member may be provided on a front side or a rear side of the copier. In the fifth modification, the biasing member is provided on a side portion of the guide member. Alternatively, as shown in FIG. 12, a projected portion 97 may be formed over the widthwise entirety of a guide member 95 and a plate spring (biasing member) 98 may be provided over the widthwise entirety of the projected portion 97.

In the fifth modification, the second projected portion 85 which is unitarily formed with the guide member 80 serves as the restricting member of this invention, Alternatively, a member independent of the guide member may serve as the restricting member.

In the aforementioned embodiment and modifications, the invention is applied to a sheet transport path extending generally in a vertical direction of a copier. Alternatively, as far as one surface of a guide member and one surface of a first counterpart member, and the opposite surface of the guide member and one surface of a second counterpart member respectively constitute sheet transport paths, the aforementioned sheet transport mechanism can be applied to any site of an image forming apparatus. For instance, the sheet transport mechanism of this invention can be applied to an image reading device (portion for inverting a double-sided document) or an image formation device (portion for inverting a sheet for double-sided image formation). Also, the sheet transport mechanism of this invention can be applied to an external sheet feeder device provided outside an image forming apparatus (for instance, a multi-stacked sheet feeder device equipped below an image forming apparatus).

As mentioned above, the sheet transport device of this invention has the feature that a guide member having both surfaces adapted for constituting sheet transport paths is openable at a large opening angle. This arrangement improves operability of an operator in removing a jammed sheet.

In summary, one aspect of the present invention relates to a sheet transport device for use in an image forming apparatus. Said sheet transport device comprises: a guide member, which is pivotally supported on a main body of the image forming apparatus to be movable between a closed position and an opened position; a first counterpart member having a surface, which with one surface of the guide member, when in the closed position, forms a first sheet transport path; a second counterpart member which is pivotally supported on the main body of the image forming apparatus to be movable between a closed position and an opened position, said second counterpart member in the closed position forms a second sheet transport path with the opposite surface of the guide member in the closed position and said second counterpart member in the opened position exposes the interior of the second sheet transport path; and retaining means for retaining the guide member at the closed position when the second counterpart member is in the open position. The guide member is retained at the closed position when the second counterpart member is set to the opened position by the retaining means.

It may be preferable that the retaining means is adapted to urge the guide member from the opened position toward the closed position.

If an operator inadvertently attempts to close the second counterpart member (e.g., side door) while leaving the guide member opened in a sheet transport device in which retaining means for urging the guide member toward the closed position is not provided, it is highly likely that the second counterpart member may be abutted against the opened guide member. However, since the guide member is automatically set to the closed position in the aforementioned arrangement of this invention, this arrangement securely prevents the second counterpart member from abutting against the guide member although an operator has to manually set the guide member to the opened position in order to remove a jammed sheet from the first sheet transport path. This arrangement is advantageous in securing a large opening angle for the guide member without a possibility that the second counterpart member may be abutted against the guide member.

The biasing means for urging the guide member toward the closed position may include an elastic member such as a spring and an element made of a rubber or is equivalent, and a weight. The biasing means may include an arrangement in which magnets each having the same polarity come into contact with each other when the guide member is set to an opened position and the guide member is urged toward the closed position aided by a repulsing force of the magnets having the same polarity.

Preferably, the retaining means is adapted to retain the guide member at the closed position by magnetic attraction force of a magnet.

Employing the aforementioned construction enables to simplify the construction of the sheet transport device. Specifically, there may be proposed an arrangement in which a magnet comes into contact with an opposing steel plate when the guide member is set at the closed position or an arrangement in which magnets having the opposite polarities come into contact with each other to retain the guide member at the closed position by a magnetic attraction force of the magnets.

According to another aspect of this invention, preferably, the retaining means is so configured as to urge the guide member toward the closed position while the guide member is being shifted between the closed position and a certain intermediate position with respect to the closed position and the opened position, and to urge the guide member toward the opened position while the guide member is being shifted between the intermediate position and the opened position.

In the above arrangement, pivotally rotating the guide member toward the opened position beyond the intermediate position automatically sets the guide member to the opened position by the biasing force of the retaining means and retains the guide member at the opened position. This arrangement does not require manual holding of the guide member at the opened position in removing a jammed sheet from the first sheet transport path, thus facilitating jammed sheet removal operation. Conversely, pivotally rotating the guide member toward the close position beyond the intermediate position automatically sets the guide member to the closed position by the biasing force of the retaining means. This arrangement provides improved operability of the guide member and securely retains the guide member at the closed position with a less external force to close the guide member.

As the retaining means for urging the guide member toward the opened position when the guide member is pivotally rotated beyond the intermediate position, preferably, the retaining means may include a projected portion which is radially outwardly projected from a center of axis of rotation of the guide member, and a biasing member which urges the projected portion in a predetermined direction. The projected portion is arranged at such a position that a line connecting a contact point of the projected portion and the biasing member and the center of axis of rotation of the guide member is aligned in parallel with the biasing direction by the biasing member.

Furthermore, it is preferable to construct the biasing member in the form of a plate spring because such an arrangement accomplishes the aforementioned operation with a simplified construction.

More preferably, the sheet transport device may comprise rotating restricting means for suspending rotation of the guide member at the certain opened position.

Preferably, the guide member may include a transparent portion or an opened portion through which an operator is enabled to visibly recognize at least part of the first sheet transport path when the guide member is set at the closed position.

An operator may have a difficulty in verifying whether there is a jammed sheet in the first sheet transport path because the guide member is retained at the closed position even after the second counterpart member is set to the opened position. However, since at least part of the guide member is made of a transparent material in the arrangement of this invention, the operator can easily see the interior of the first sheet transport path through the transparent section so as to verify whether there is a jammed sheet in the first sheet transport path. As an altered form, the entirety of the guide member may be made of a transparent material. The larger the transparent area is, the higher the visibility is. In the case where the guide member is formed with an opening, one or more than one opening may be formed. Alternatively, a multitude of holes may be formed in the guide member. For example, a plate formed with a multitude of holes or a plate in the form of a mesh may be usable.

According to another aspect of this invention, a sheet transport device for use in an image forming apparatus, comprises: a guide member pivotally supported on a main body of the image forming apparatus via a first axis to be movable between a closed position and an opened position; a first counterpart member, one surface of a guide member and the first counterpart member define a first sheet transport path when the guide member is in the closed position, and an interior of the first sheet transport path is exposed to when the guide member is in the opened position; a side door which is pivotally supported on the main body of the image forming apparatus via a second axis which is perpendicular to the first axis to be movable between a closed position and an opened position, said side door and the other side of the guide member define a second sheet transport path, and an interior of the second sheet transport path is exposed to when the side door is in the opened position, and said side door is provided with a pressing portion; a guide member shaft, on which the guide member is mounted, which is rotatable about the first axis and movable along the first axis, said pressing portion of the side door and the guide member shaft are so constructed such that the guide member shaft is being pressed along the first axis by the motion of the pressing portion of the side door when the side door is being closed; and motion conversion means for converting the motion of said pressing portion of the side door to the rotational motion of the guide member about the first axis.

With this arrangement, operations of the guide member are in association with open/close operations of the side door, and the guide door is set to the opened position when the side door is opened. However, the guide member is operated in such a manner that the guide member shaft (rotary shaft) of the guide member slides in the axial direction thereof as the pressing portion presses the lead end of the guide member shaft (rotary shaft) in order to pivotally rotate the guide member in association with the sliding of the rotary shaft. Compared to the conventional arrangement in which a side door directly presses the guide member to the closed position, this arrangement enables to secure a large opening angle of the guide member, thereby facilitating jammed sheet removal operation.

The rotary shaft and the guide member may be made of an integral member or made individually.

Preferably, the motion conversion means preferably includes: a spiral portion formed around one axial end of the guide member shaft; bias means for biasing the guide member shaft toward either one of opposite ends along the first axis; and a spiral guide member for guiding the spiral portion formed on the guide member shaft to slidingly and spirally move along the spiral guide member, such that the guide member shaft is linearly displaced along the first axis and is simultaneously angularly displaced about the first axis, so as to pivotally rotate the guide member mounted on the guide member shaft.

In the above arrangement, the guide member is opened and closed by allowing the pressing portion to press toward and away from the guide member shaft (rotary shaft) in the axial direction thereof so as to slide the rotary shaft in the axial direction. As the rotary shafts slides in the axial direction thereof, the spiral portion spirally slides relative to the guide support member so as to pivotally rotate the guide member.

The spiral portion may be such that a spiral rib or a spiral groove is formed in one axial end portion of the rotary shaft.

Preferably, the guide member may be retained at the closed position by the biasing force of the biasing means.

Normally, an image forming apparatus such as a copier is used in a state that a side door is kept closed. Accordingly, it may be preferable that the biasing means (e.g., elastic member) is free from a physical load (namely, is biased in a restoring direction by a restoring force thereof) when the side door is set at the closed position.

Also, it is preferable that an angle defined by the guide member at the closed position and the opened position thereof is 20 degrees or more. In other words, the opening angle θ of the guide member is 20 degrees or more. Setting the guide member at such an opening angle improves operability of an operator in removing a jammed sheet. More preferably, the opening angle θ of the guide member is 40 degrees or more.

Although the present invention has been fully described by way of example with reference to the accompanying drawings, it is to be understood that various changes and modifications will be apparent to those skilled in the art. Therefore, unless otherwise such change and modifications depart from the scope of the invention, they should be construed as being included therein.

This application is based on Japanese patent application No. 2001-91163 filed in Japan Patent Office on Mar. 27, 2001, the contents of which are hereby incorporated by references.

What is claimed is:

1. A sheet transport device for use in an image forming apparatus, comprising:

a guide member, which is pivotally supported on a main body of the image forming apparatus to be movable between a closed position and an opened position;

a first counterpart member having a surface, which with one surface of the guide member, when in the closed position, forms a first sheet transport path;

second counterpart member which is pivotally supported on the main body of the image forming apparatus to be movable between a closed position and an opened position, said second counterpart member in the closed position forms a second sheet transport path with the opposite another surface of the guide member in the closed position and said second counterpart member in the opened position exposes the interior of the second sheet transport path; and retaining means for retaining the guide member at the closed position when the second counterpart member is in the open position, wherein the retaining means is so configured as to urge the guide member toward the closed position while the guide member is in between the closed position and a certain intermediate position with respect to the closed position and the opened position and to urge the guide member toward the opened position while the guide member is in between the intermediate position and the opened position.

2. The sheet transport device according to claim 1, wherein the retaining means includes a projected portion which is radially outwardly projected from a rotational axis of the guide member, and a biasing member which urges the projected portion in a predetermined direction, the projected portion being arranged at such a position that a line connecting a contact point of the projected portion and the biasing member and the center of rotation axis of the guide member is aligned in parallel with the biasing direction by the biasing member when the guide member is at the certain intermediate position.

3. The sheet transport device according to claim 2, wherein the biasing member includes a plate spring.

4. The sheet transport device according to claim 1, further comprising rotating restricting means which disables further rotation of the guide member at the certain opened position.

5. A sheet transport device for use in an image forming apparatus, comprising:

a guide member pivotally supported on a main body of the image forming apparatus via a first axis to be movable between a closed position and an opened position;

a first counterpart member, one surface of the guide member and the first counterpart member define a first sheet transport path when the guide member is in the closed position, and an interior of the first sheet transport path is exposed to when the guide member is in the opened position;

a side door which is pivotally supported on the main body of the image forming apparatus via a second axis which is perpendicular to the first axis to be movable between a closed position and an opened position, said side door and the other side of the guide member define a second sheet transport path, and an interior of the second sheet transport path is exposed to when the side door is in the opened position, and said side door is provided with a pressing portion;

a guide member shaft, on which the guide member is mounted, which is rotatable about the first axis and movable along the first axis, said pressing portion of the side door and the guide member shaft are so constructed such that the guide member shaft is being pressed along the firs axis by the motion of the pressing portion of the side door when the side door is being closed;

motion conversion means for converting the motion of said pressing portion of the side door to the rotational motion of the guide member about the first axis.

6. The sheet transport device according to claim 5, wherein the motion conversion means including:

a spiral portion formed around one axial end of the guide member shaft;

bias means for biasing the guide member shaft toward either one of opposite ends along the first axis; and a spiral guide member for guiding the spiral portion formed on the guide member shaft to slidingly and spirally move along the spiral guide member, such that the guide member shaft is linearly displaced along the first axis and is simultaneously angularly displaced about the first axis, so as to pivotally rotate the guide member mounted on the guide member shaft.

7. The sheet transport device according to claim 6, wherein the guide member is retained at the closed position by a biasing force of the bias means.

8. The sheet transport device according to claim 5, wherein an angle defined by the guide member at the closed position and the opened position thereof is 20 degrees or more.

* * * * *